US006793425B2

(12) United States Patent
Yoshikawa et al.

(10) Patent No.: US 6,793,425 B2
(45) Date of Patent: Sep. 21, 2004

(54) FEEDING DEVICE WITH LOADING DEVICE ADAPTED TO HOLD A PLURALITY OF MEDIA OR A STORAGE CASE WITH A PLURALITY OF MEDIA AND RECORDING APPARATUS CONTAINING SAME

(75) Inventors: Junichi Yoshikawa, Tokyo (JP); Katsuyuki Yokoi, Kanagawa (JP); Masahiro Taniguro, Kanagawa (JP); Tadashi Hanabusa, Kanagawa (JP); Tetsuyo Ohashi, Kanagawa (JP); Kiichiro Takahashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/347,872

(22) Filed: Jan. 22, 2003

(65) Prior Publication Data

US 2003/0143011 A1 Jul. 31, 2003

(30) Foreign Application Priority Data

Jan. 31, 2002 (JP) ..... 2002-023463

(51) Int. Cl.[7] ..... B65H 1/12; B65H 1/18; B41J 13/10

(52) U.S. Cl. ..... 400/624; 400/636; 400/629; 271/145; 271/160; 271/162

(58) Field of Search ..... 271/145, 147, 271/157, 160, 162; 400/605, 624, 625, 628, 629, 634, 636

(56) References Cited

U.S. PATENT DOCUMENTS

| | | | | | |
|---|---|---|---|---|---|
| 4,796,035 | A | | 1/1989 | Kawasaki et al. | 346/108 |
| 5,116,034 | A | * | 5/1992 | Trask et al. | 271/2 |
| 5,223,858 | A | | 6/1993 | Yokoi et al. | 346/134 |
| 5,290,024 | A | | 3/1994 | Takahashi | 271/122 |
| 5,358,230 | A | | 10/1994 | Ikemori et al. | 271/114 |
| 5,474,287 | A | | 12/1995 | Takahashi | 271/10.13 |
| 5,580,042 | A | | 12/1996 | Taniguro et al. | 271/274 |
| 5,620,174 | A | | 4/1997 | Taniguro et al. | 271/10.12 |
| 5,672,019 | A | | 9/1997 | Hiramatsu et al. | 400/624 |
| 5,725,319 | A | | 3/1998 | Saito et al. | 400/629 |
| 5,793,399 | A | | 8/1998 | Kawakami et al. | 347/104 |
| 5,909,872 | A | | 6/1999 | Takahashi | 271/116 |
| 5,982,400 | A | | 11/1999 | Yokoi et al. | 346/134 |
| 6,092,893 | A | | 7/2000 | Yokoi et al. | 347/104 |
| 6,139,010 | A | | 10/2000 | Yokoi | 271/225 |
| 6,168,270 | B1 | | 1/2001 | Saikawa et al. | 347/104 |
| 6,311,039 | B1 | | 10/2001 | Funamizu et al. | 399/394 |
| 6,406,201 | B1 | * | 6/2002 | Beretta et al. | 400/605 |
| 2002/0167124 | A1 | | 11/2002 | Hanabusa | 271/125 |
| 2002/0171193 | A1 | | 11/2002 | Asai et al. | 271/121 |
| 2003/0058322 | A1 | * | 3/2003 | Suzuki et al. | 347/106 |

FOREIGN PATENT DOCUMENTS

| | | | | |
|---|---|---|---|---|
| JP | 62056225 A | * | 3/1987 | B65H/1/26 |
| JP | 09235023 A | * | 9/1997 | B65H/1/04 |

* cited by examiner

*Primary Examiner*—Daniel J. Colilla
(74) *Attorney, Agent, or Firm*—Fitzpatrick, Cella, Harper & Scinto

(57) ABSTRACT

A feeding device has a loading unit for allowing one of a plurality of recording media and a storage case having a plurality of recording media contained therein to be selectively loaded thereon, a feeding roller for feeding the recording media from the loading unit, and ribs for preventing the storage case from floating to restrict the position of the storage case relative to the feeding roller.

11 Claims, 24 Drawing Sheets

FEEDING DEVICE WITH LOADING DEVICE ADAPTED TO HOLD A PLURALITY OF MEDIA OR A STORAGE CASE WITH A PLURALITY OF MEDIA AND RECORDING APPARATUS CONTAINING SAME

BACKGROUND OF THE INVENTION

1. Field of the Invention

The present invention relates to a feeding device for feeding recording media from within a loaded storage case to a feeding device when a plurality of recording media such as films and recording sheets are contained within the storage case, and a recording apparatus for recording information on the recording media.

2. Description of the Related Art

High image quality at a level comparable to silver halide films is now demanded of color inkjet printers. In order to achieve this quality, it is fundamental that one must eject an extremely small amount of ink with high accuracy. Furthermore, not only inkdrops but also devisal in recording media is also necessary and in order to express silver film shades, various kinds of recording media having surfaces such as a super glossy, glossy, and mat (pearl) surface have been developed corresponding to users' preferences.

Different surface states of recording media generally make for different color development requirements. Therefore, it is generally necessary to change color image processing and printing ink volume for each kind of recording media to be optimized. A selection of parameters for optimization is performed by a printer driver that is software stored in a personal computer (referred to below as a PC) such as a host computer connected to a printer. However, the operation to select and set parameters for a recording medium to use at present is manually performed by a user. Therefore, in order to record information with a printer, the user must select and set the type of recording medium, on which information is to be recorded, on a setting screen of the printer driver.

As for the size of the recording medium, there are various forms, such as an L-form, which is a so-called service size of a silver halide film, a double L-form, which is double the size of the L-form, and a postcard form, corresponding to various uses, and the size is also set on a setting screen manually by the user.

Loading the recording media on the printer requires one to directly touch unpacked and bared recording media (referred to as a naked medium below) with one's hand to replenish the printer with the required number of the recording media.

As described above, it has been difficult and troublesome for inexperienced users to select the specification of the recording media, such as a type and a size, on a setting screen of the printer driver.

The need for printing image data shot with a digital camera without connecting the printer to a PC is increasing recently, so that also gradually increasing is the need for printers which are capable of using the printer in a non-connected state to the PC by directly connecting the digital camera to the printer or by directly inserting a memory card having image data shot and stored therein into the printer.

When the recording media are printed with a printer not connected to a PC, various operations are performed on a display screen of the printer or the digital camera. However, the display screen of the printer and the digital camera are each small in view of portability and manufacturing cost, so that it may be difficult in viewing the screen to select the recording media as described above.

Touching naked recording media before recording with a user's hand may soil a recording surface such as a glossy surface with finger marks and will have a bad influence on the recording quality.

In normal operational situations of the printer, it is to generally necessary to switch the recording media from normal sheets to recording media corresponding to photographic shades (referred simply to as photographic shade media below). After printing photographic shade media, the remaining unused photographic shade media must be stored in an original containing bag to prevent them from bad influence due to dust and external light.

Furthermore, it is convenient to easily switch on demand from normal A-4 size sheets to photographic shade media with an L-shape stored in a container. There have been individual printers specialized for each of the media, whereas there is no printer having one feeding mechanism that can correspond to both the normal sheets and the L-shaped photographic shade media.

Such a printer may be achieved by arranging respective feeding inlets corresponding to the two types of recording media, each inlet being provided with each specialized feeding mechanism; however, manufacturing cost is increased and the entire printer obviously becomes large in size.

SUMMARY OF THE INVENTION

It is an object of the present invention to provide a feeding device and a recording apparatus, both enable a plurality of recording media and a plurality of recording media contained in a storage case to be excellently fed, respectively.

In accordance with these objects, there is provided a feeding device for feeding recording media comprising a loading unit adapted to allow one of a plurality of recording media and a storage case having a plurality of recording media contained therein to be selectively loaded thereon and feeding means for feeding the recording media from the loading unit.

In accordance with yet another aspect of the invention, there is provided a recording apparatus for recording information on recording media comprising a loading unit adapted to allow one a of plurality of recording media and a storage case having a plurality of recording media contained therein to be selectively loaded thereon, a recording unit, and feeding means for feeding the recording media from the loading unit to the recording unit.

Further objects, features and advantages of the present invention will become apparent from the following description of the preferred embodiments with reference to the attached drawings.

DESCRIPTION OF THE PREFERRED EMBODIMENTS

Embodiments according to the present invention will be specifically described with reference to the drawings.

<First Embodiment>

Figure 1:
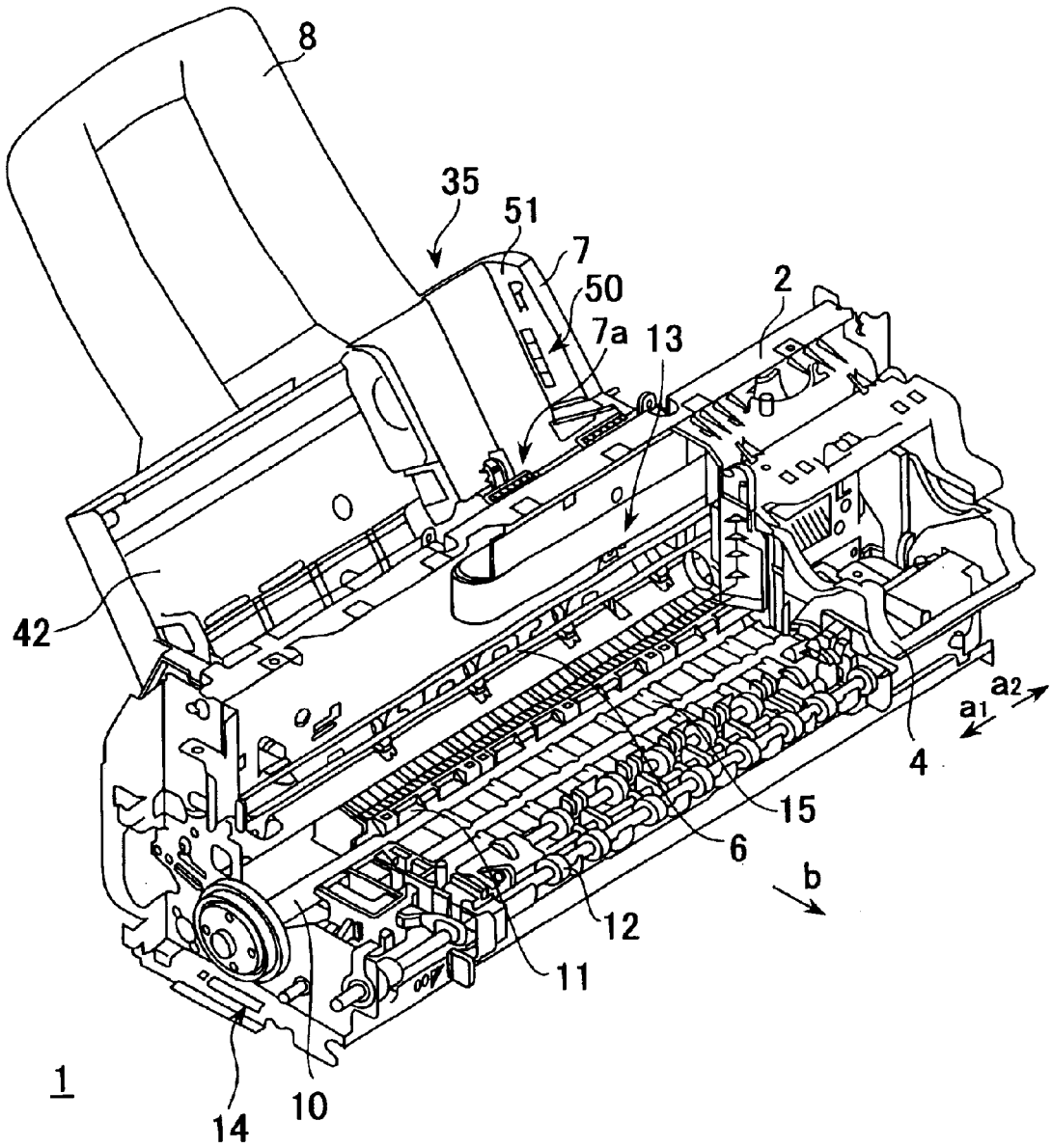
FIG. 1 is an entire perspective view of a printer according to a first embodiment of the present invention.

FIG. 1 is a perspective view of an entire inkjet printer according to a first embodiment of the present invention. A serial-type inkjet printer will be described below as the specific embodiment of the present invention with reference to the drawings.

An inkjet printer 1 according to the embodiment has generating means for generating thermal energy used for ejecting liquid ink and a recording head, in which state transformation of the ink arises by the thermal energy. This system enables recorded characters and images to achieve increased density and fineness. In particular, according to the embodiment, an exothermic element is used as the means for generating thermal energy so as to eject ink using the pressure generated by bubbles produced when the ink is heated with the exothermic element to bring about film boiling. The ink ejecting system is not limited to the type using the exothermic element and an ink ejecting system may be adopted, in which an electromechanical transducer such as a piezoelectric element is used to apply mechanical vibration to the ink for ejecting the ink, for example.

According to the embodiment, recording sheets serve as recording media to be recorded with characters and images thereon; other recording media such as films may be certainly applied to the embodiment. The inkjet printer according to the embodiment can load a plurality of unpacked recording media (naked recording media) and a plurality of recording media contained in a container. Any one of the naked recording media and the mediapack is selected to load on the printer.

The printer 1 according to the first embodiment, as shown in FIG. 1, comprises a recording unit 2 for recording information such as images on recording media and a feeding unit 7 for feeding the recording media to the recording unit 2.

The recording unit 2 comprises a recording head (not shown) for recording information on recording media, a carriage 4 for supporting the recording head, a transportation mechanism 13 for transferring the carriage 4, a conveying mechanism 14 for conveying the recording media fed from the feeding unit 7 to the recording head while discharging the recording media having information recorded thereon by the recording head, and a control system 9 (FIG. 2) having control circuits for controlling the entire printer 1.

The recording head is arranged adjacently to a conveying path of recording media, and ejecting nozzles (not shown) for ejecting ink are provided at a position opposing the conveying path of recording media. The recording head comprises an electric resistance element (not shown) for generating thermal energy for ejecting the supplied ink. The recording head ejects ink by film boiling, for example, using the thermal energy applied by the electric resistance element.

The carriage 4 supports a tank for containing the ink supplied from an ink supply. The tank is provided with containing sections separated with partition walls for respectively storing ink of yellow, magenta, cyan, and black.

The carriage 4 is provided with a bearing section movably supported by the transportation mechanism 13 and an ink supplying path, through which each containing section and the recording head are communicated, for supplying ink to the recording head from each of the containing sections.

The transportation mechanism 13 comprises principal and auxiliary shafts (not shown) for supporting the carriage 4 movably in directions indicated by arrows a1 and a2 in FIG. 1, which are principal scanning directions, and a carriage motor (not shown) for driving the carriage 4 via a carriage belt 6.

The conveying mechanism 14 comprises a conveying roller 10 and a pinch roller 11 arranged upstream of the recording head in the conveying direction of recording media, which is an auxiliary scanning direction intersecting with the principal scanning direction, for conveying recording media toward the recording head; a discharge roller 12 arranged downstream of the recording media for discharging the recording media from the recording head, a platen 15 for supporting the recording media to be recorded by the recording head, and an LF (line feed) motor (not shown) for rotationally driving the conveying roller 10 and the pinch roller 11.

In the recording unit 2 structured as described above, the recording media supplied from the feeding unit 7 are conveyed in the direction indicated by arrow b in FIG. 1 by being pinched between the conveying roller 10 and the pinch roller 11, which are rotated by the LF motor. The carriage 4 mounting the recording head thereon is reciprocated via the carriage belt 6 along the directions indicated by the arrows a1 and a2. On the conveyed recording media, desired information such as an image is recorded by ejecting ink at a position located on the platen 15 with the recording head. Then, the recording media on the platen 15 is conveyed by the discharge roller 12 of the conveying mechanism 14 for being discharged outside the recording unit 2.

Figure 2:
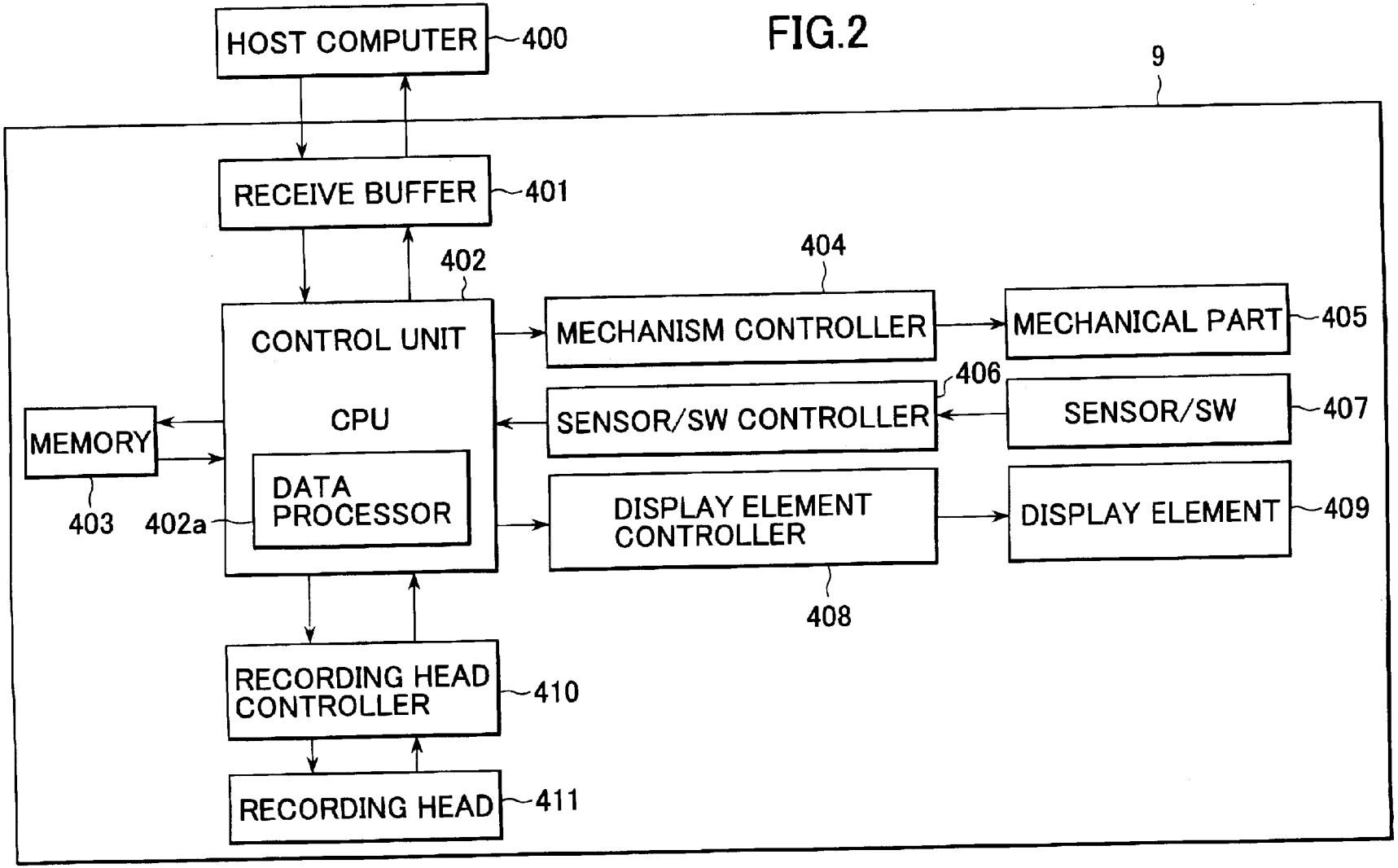
FIG. 2 is a block diagram showing a control system of the printer according to a first embodiment.

FIG. 2 is a block diagram of the control system 9 included in the printer 1 according to the embodiment. From a host computer 400, data to be recorded (referred to as image data below) such as a character or an image is inputted into a receive buffer 401 of the control system 9. Data for ensuring whether the data is correctly transferred and data for informing the operational state of the printer 1 are returned to the host computer 400 from the printer 1. The data in the receive buffer 401 is transferred to a memory 403 to be temporarily stored in RAM (random access memory) under control of a control unit 402 having the CPU. A mechanism controller 404 controls the driving of mechanical parts 405 such as the carriage motor and the LF motor based on commands from the control unit 402. A sensor/SW (switch) controller 406 sends signals from a sensor/SW unit 407 having various sensors and switches to the control unit 402. A display element controller 408 controls a display element unit 409 having LEDs (light emitting diodes) of a display panel group and liquid crystal elements based on commands from the control unit 402. A recording head controller 410 detects the state of a recording head 411 such as temperature information so as to send it to the control unit 402. A data processor 402*a* performs the image data process input in the receive buffer 401 so as to produce recording data by detecting boundaries and blanks between colors.

Figure 6:
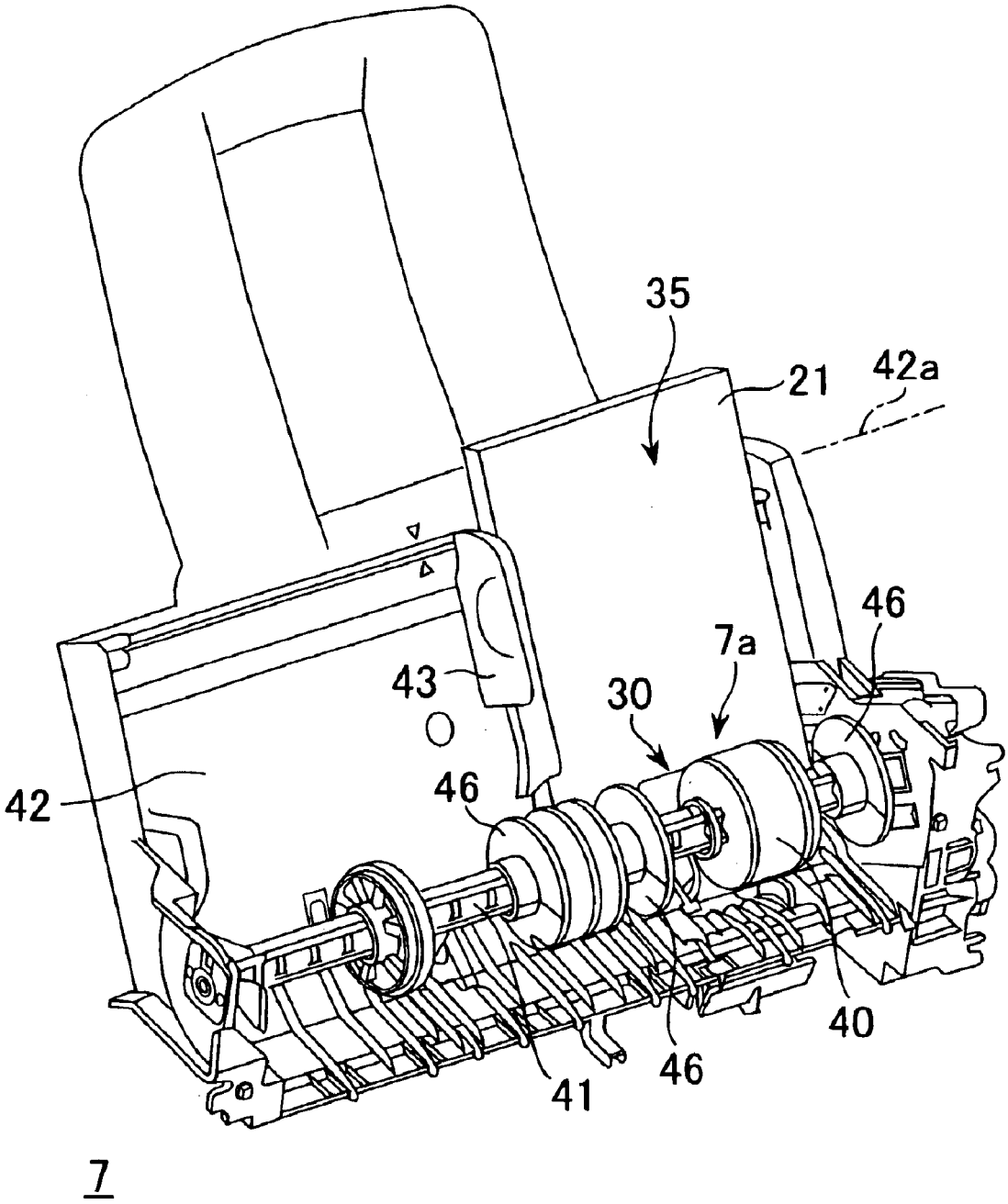
FIG. 6 is a perspective view showing the mediapack loaded on a feeding unit.

The feeding unit 7 included in the printer 1 according to the embodiment, as shown in FIGS. 1 and 6, comprises a loading part 35 for loading naked recording media or a mediapack having recording media contained therein, a feeding roller 40 and a separating roller 44 (shown in FIG. 7) for separating recording media one at a time so as to feed it toward the recording unit 2, and a driving mechanism (not shown) for rotationally driving the feeding roller 40 and the separating roller 44.

The loading part 35 comprises a feeding tray 8 to have recording media loaded thereon and a pressure plate 42 for pressing one end of a recording medium in the feeding direction (referred to as a front end below) into contact with the feeding roller 40.

Figure 3:
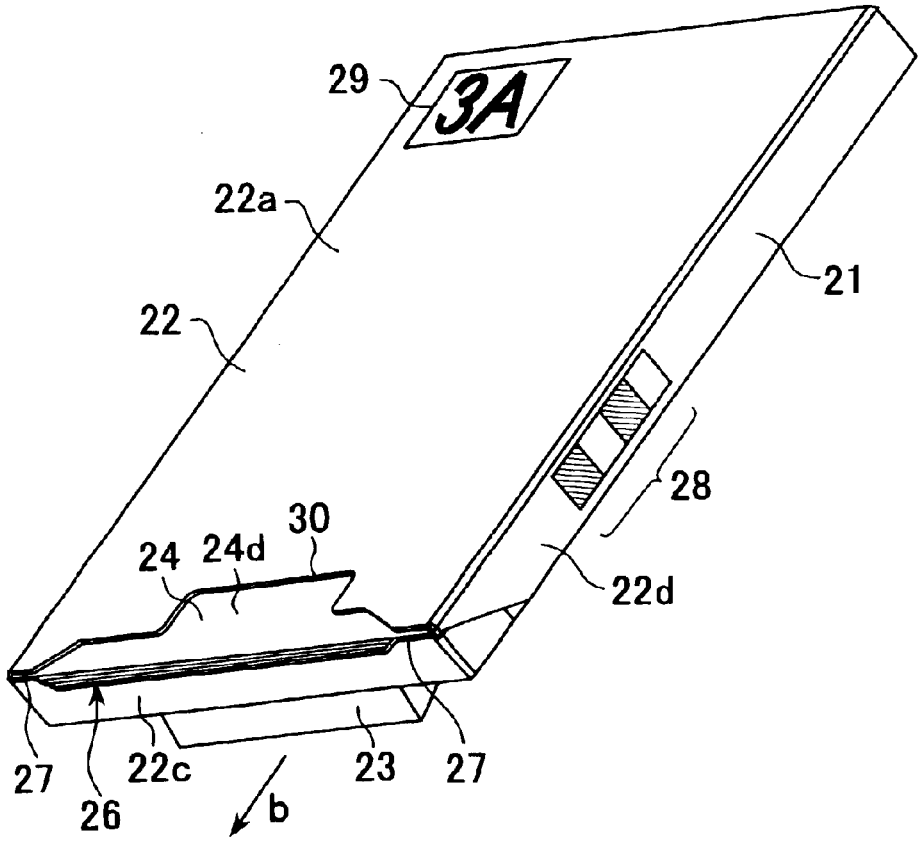
FIG. 3 is an external perspective view of a mediapack incorporating the printer according to the first embodiment.
Figure 4:
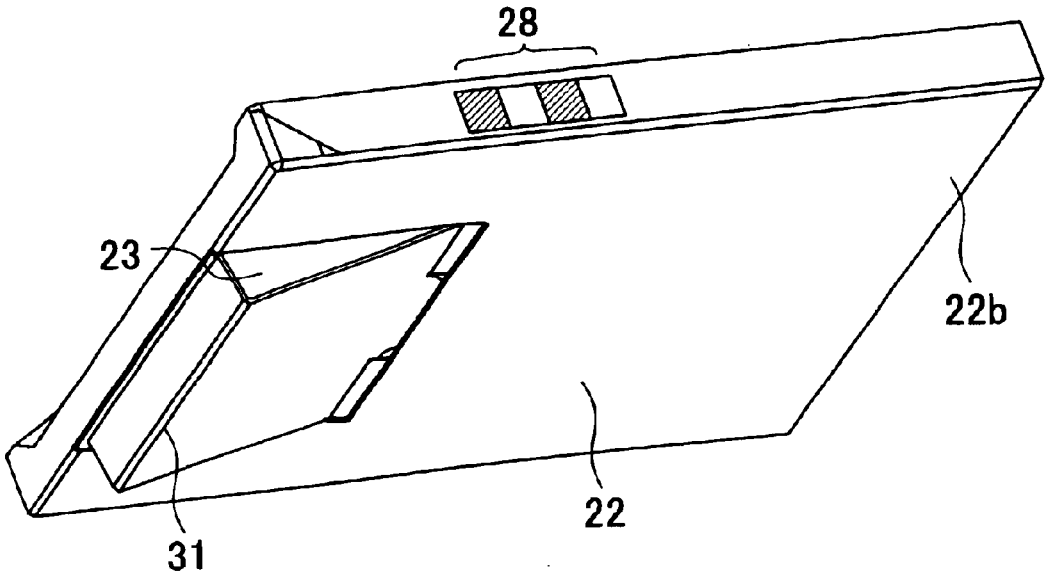
FIG. 4 is an external perspective view of the mediapack viewed from the bottom surface.

Next, the structure of the mediapack for use with the printer 1 according to the embodiment will be described. FIG. 3 is an external perspective view of a mediapack 21 viewed from the above; FIG. 4 is an external perspective view of the mediapack 21 viewed from the below.

As shown in FIGS. 3 and 4, the mediapack 21 is structured to have a plurality of recording media 24 contained within a storage case 22. The bottom surface 22*b* of the storage case 22 is provided with a movable plate 23. The movable plate 23 is provided with a projection 31 protruding outward from the storage case 22. The function of the projection 31 will be described later. An opening 30 is formed at one side end of the mediapack 21 so as to allow the front end of the recording media 24 contained in the storage case 22 to be accessable from outside. Through the opening 30, the feeding roller 40 is arranged so as to press itself directly into contact with one sheet positioned on the top 24*a* of the recording media 24 within the storage case 22. By the pressing force and the rotating feeding roller 40, the recording media 24 are fed out one at a time from the mediapack 21.

The opening 30 is formed at a position corresponding to the feeding roller 40 to have a size slightly larger than the outer shape of the feeding roller 40. In order to prevent recording media from being degraded by dust and outer light, the opening 30 has as small a size as possible.

The front face 22*c* of the storage case 22 is provided with checking claws 27 disposed at both ends of the opening 30 in the width direction for preventing the recording media 24 from dropping off the storage case 22. Furthermore, on the side of the front face 22*c* of the storage case 22, a clearance 26 capable of allowing at least one sheet on the top 24*a* of the recording media 24 within the storage case 22 to smoothly pass therethrough is formed between the top surface 22*a* of the storage case 22 and upper ends of the checking claws 27 facing the top surface 22*a*.

One sheet of the recording media 24 fed out from the storage case 22 passes through the clearance 26 so as to be conveyed to the recording unit 2 shown in FIG. 1 by proceeding in the direction indicated by arrow b in FIG. 3.

On a side face 22*d* of the storage case 22, an identification mark 28 is printed for identifying a class (specification) of the recording media 24 contained in the case 22 such as a kind and a size. This identification mark 28 has media information about the sheet type such as super glossy, glossy, or mat and the sheet size such as L-form, double L-form, and postcard form, which are coded according to a predetermined prescription. According to the embodiment, as shown in FIG. 4, the identification mark 28 uses four bits arranged in the order of black, white, black, and white so as to be read by a specification-identifying sensor 50, which will be described later, included in the feeding unit 7.

In the similar way, on the top surface 22*a* of the storage case 22, an identification symbol 29 having media information about the sheet type and the sheet size coded according to a predetermined prescription is printed to have a comparatively large size to stand out clearly.

The identification symbol 29, which will be described in detail later, is a symbol enabling a user to easily input on a setting screen of a printer driver and is expressed by easily recognizable characters. In addition, the identification mark 28 and the identification symbol 29 may be printed on slips such as stickers and then bonded on the storage case 22.

On the mediapack 21, the identification mark 28 and the identification symbol 29 are printed differently corresponding to the sheet type and the sheet size of the recording media contained therein; of course, the identification mark 28 and the identification symbol 29 have one-to-one correspondence, expressing the same description.

Figure 5C:
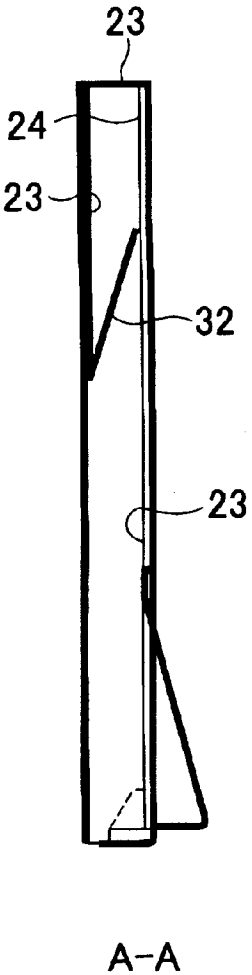
FIGS. 5A to 5C include perspective and side views showing the structure of the mediapack.
Figure 5B:
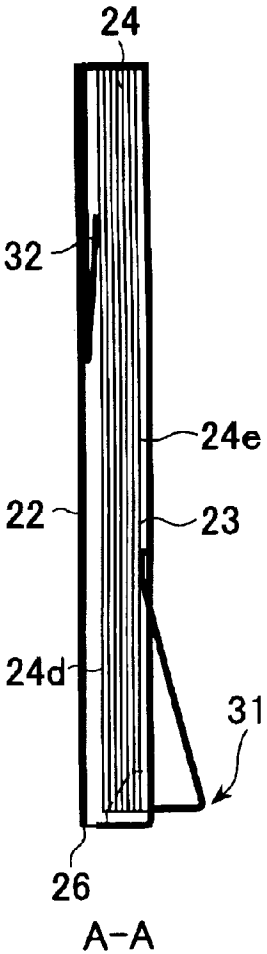

Next, the structure 21 of the mediapack 21 will be described in detail with reference to FIGS. 5A to 5C.

Figure 5A:
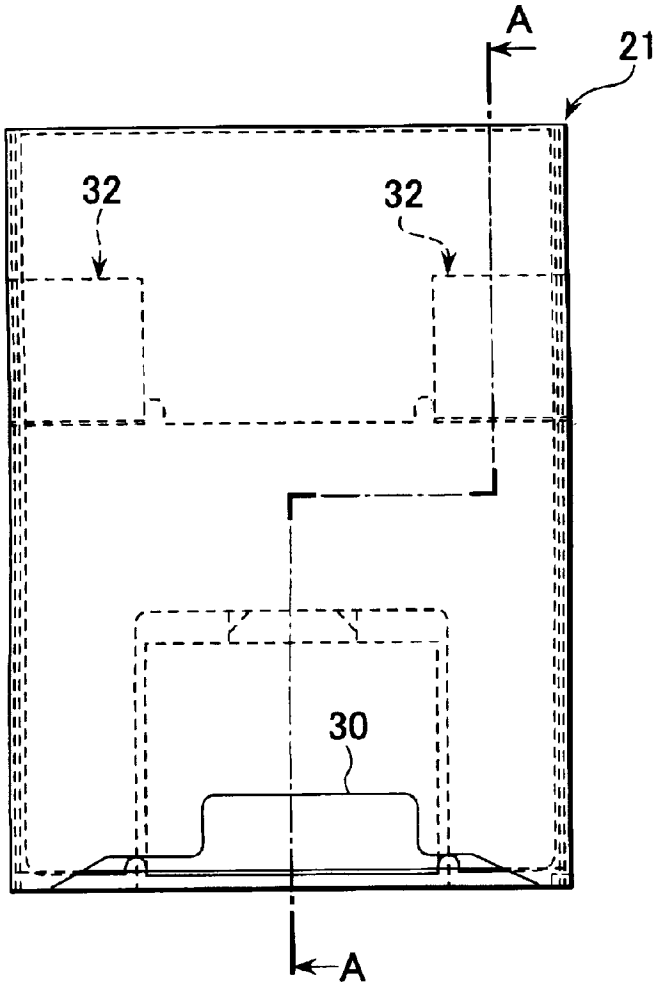

FIG. 5A is a perspective plan view of the structure 21; FIGS. 5B and 5C are sectional views at the line A—A of FIG. 5A, respectively showing the different remaining amount of the recording media 24; FIG. 5B shows a larger remaining amount while FIG. 5C shows the state of one remaining sheet of the recording media 24.

The storage case 22 and the movable plate 23 described above may be preferably formed of a sheet material such as a paper board and a plastic sheet; folding the sheet enables manufacturing cost to be reduced. As shown in FIGS. 5B and 5C, the movable plate 23 has the projection 31 protruding close to the bottom 24*e* of the recording media 21, and the movable plate 23 extends toward the top 24*d* of the recording media 21 from the projection 31 so as to wrap around the rear end 24*b* of the recording media 21. As shown in FIGS. 5A and 5B, the movable plate 23 is provided with folded back pieces 32 respectively folded at positions of both ends of the movable plate 23 opposing the top 24*a* of the recording media 21 in the width direction of the recording media 21. In addition, the movable plate 23 is not limited to the shape described above, and the other shapes may obviously be adopted.

The folded piece 32 has elasticity so as to have an urging force in the direction separating from the top surface 22*a* of the storage case 22. By the urging force, the folded pieces 32 always urge the recording media 24 close to the bottom surface 22*b* of the storage case 22 by changing the inclination angle relative to the top surface 22*a* corresponding to the remaining amount of the recording media 24 within the storage case 22. Therefore, in the mediapack 21, the storage position of the recording media 24 is securely restricted so as to prevent the recording media 24 from being located at a position opposing the clearance 26 mentioned above. That is, even in the case where the mediapack 21 is removed from the feeding unit 7 during use, the recording media 24 cannot drop off from the clearance 26.

Next, the operation when the mediapack 21 is loaded on the feeding unit 7 will be described.

FIG. 6 is a perspective view of the feeding unit 7 having the mediapack 21 loaded thereon. The loading part 35 is constructed so that the mediapack 21 can be attached to an entrance 7*a* for admitting the recording media 24. The feeding unit 7 is provided with the feeding roller 40 supported by a feeding shaft 41 and arranged at a position opposing the opening 30 of the mediapack 21. The feeding roller 40 is rotated integrally with the feeding shaft 41 by a driving mechanism which rotationally drives the feeding shaft 41.

Figure 7:
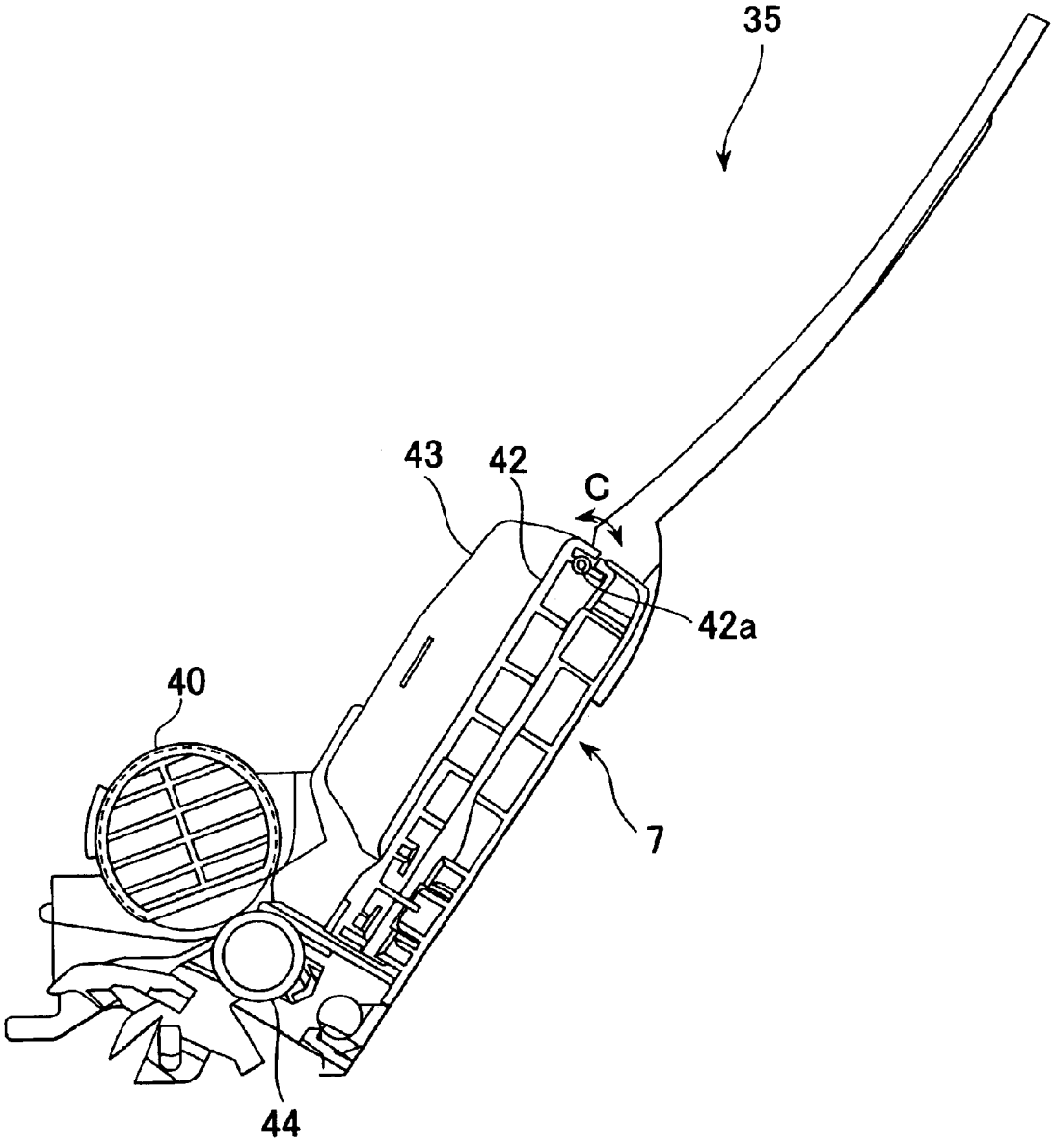
FIG. 7 is a sectional view of the feeding unit without recording media loaded thereon.

The loading part 35 of the feeding unit 7 is provided with the pressure plate 42 supported about a rotating shaft 42*a* arranged in parallel with the feeding shaft 41 rotatably in arrow c direction in FIG. 7. The pressure plate 42 is rotated in a direction approaching the recording media 24 loaded on the loading part 35 by an urging force of an elastic member such as a spring (not shown). The pressure plate 42 is rotated about the rotating shaft 42*a* by a driving mechanism simultaneously with the rotation of the feeding shaft 41, so that the front end of the recording media 24 in the feeding direction is pressed into contact with the feeding roller 40 with an appropriate pressure. Therefore, in the feeding unit 7, by the pressing force of the pressure plate 42 and the rotational force of the feeding roller 40, a proceeding force is applied to one sheet of the recording media 24 positioned at the top 24*a* within the mediapack 21, so that the recording media 24 are separated by a separating mechanism (not shown) and fed one sheet at a time.

The pressure plate 42 is provided with a side guide 43 arranged movably in the width-wise direction of the recording media 24 for guiding the recording media 24 in the feeding direction so as to restrict the position of the recording media 24 in the width-wise direction with an appropriate frictional force. The side guide 43 can adjust the position of the recording media 24 in the width direction by abutting the side guide 43 against one side face of the recording media 24 in the width-wise direction by a user. For the side guide, the position of the recording media 24 can be kept in the direction substantially perpendicular to the principal scanning direction of the recording unit 2, preventing the recording media 24 from being skewed during feeding.

FIG. 7 is a sectional view of the feeding unit 7 without the recording media 24 loaded on the loading part 35 at a section passing through the feeding roller 40. The feeding unit 7 is provided with a separating roller 44 arranged at a position opposing the feeding roller 40. The separating roller 44 has an appropriate and predetermined frictional load torque so that the roller 44 is rotated when an external force having a predetermined value or more is applied while not being rotated by a torque less than a predetermined value. The feeding unit 7 has a function to separate a plurality of the recording media 24, which enter the contact point (referred to as a nip below) between the feeding roller 40 and the separating roller 44, into one sheet at a time so as to be passed through toward the recording unit 2.

Figure 8:
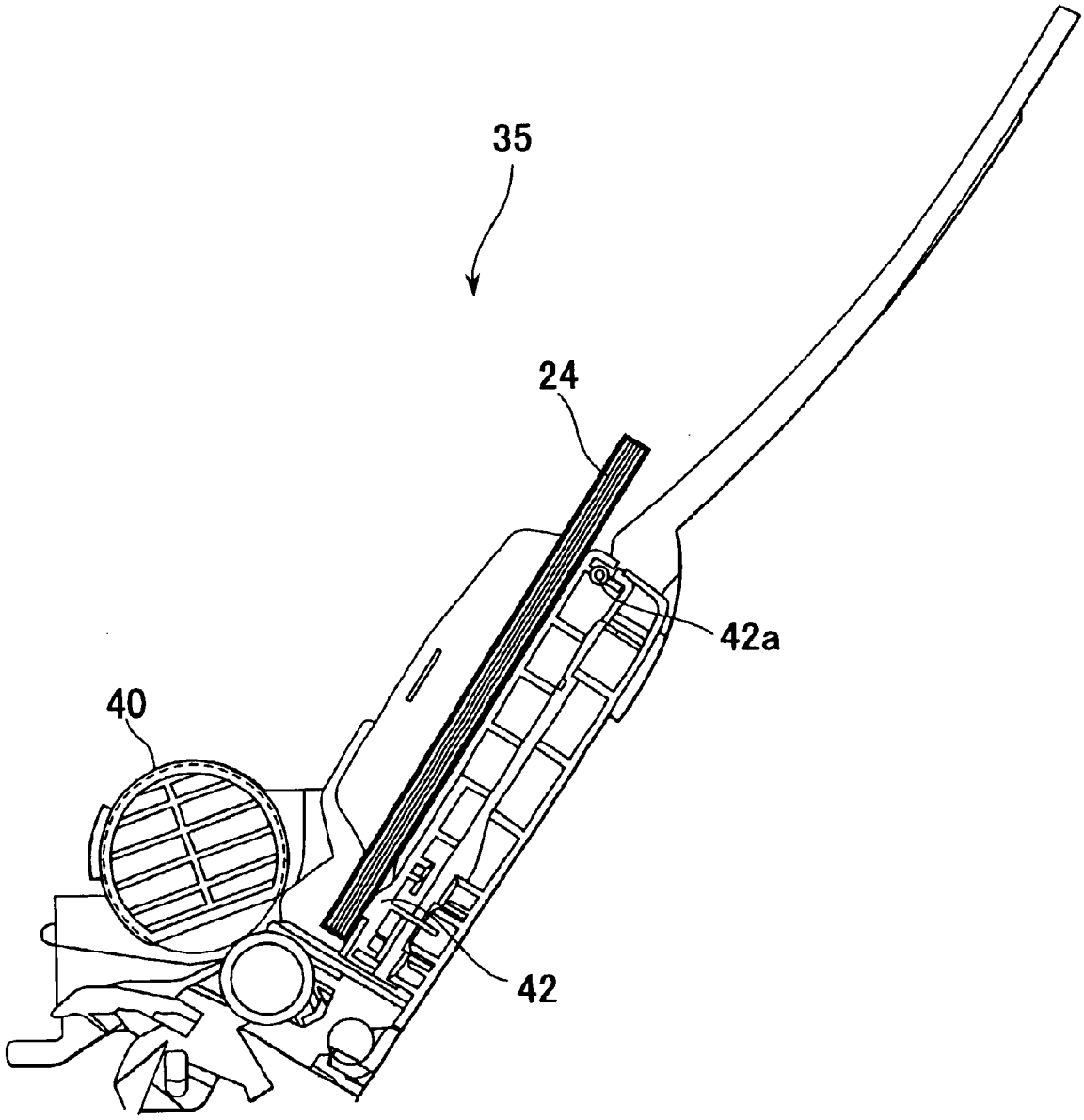
FIG. 8 is a sectional view of the feeding unit having naked recording media loaded thereon.

FIG. 8 is a sectional view of the feeding unit 7 with a plurality of the naked recording media 24 not contained in the mediapack 21 and loaded on the loading part 35. In the case where the naked recording media 24 are loaded on the loading part 35, the pressure plate 42 is in a standby mode and the feeding roller 40 does not abut the naked recording media 24. When the feeding unit 7 starts the feeding operation, the pressure plate 42 is rotated about the rotational shaft 42*a* so as to press the front end of the naked recording media 24 into contact with the feeding roller 40.

The feeding unit 7 is also provided with a returning mechanism (not shown) for returning the remaining naked recording media 24, separated by the separating mechanism mentioned above, to the original loading position by levers and claws (not shown) after a plurality of the recording media 24 enter the nip from the loading position. Since the separating mechanism and the returning mechanism are known techniques, the detailed description is omitted. The separating mechanism is not limited to the type described above, and other known systems may be adopted.

Figure 9:
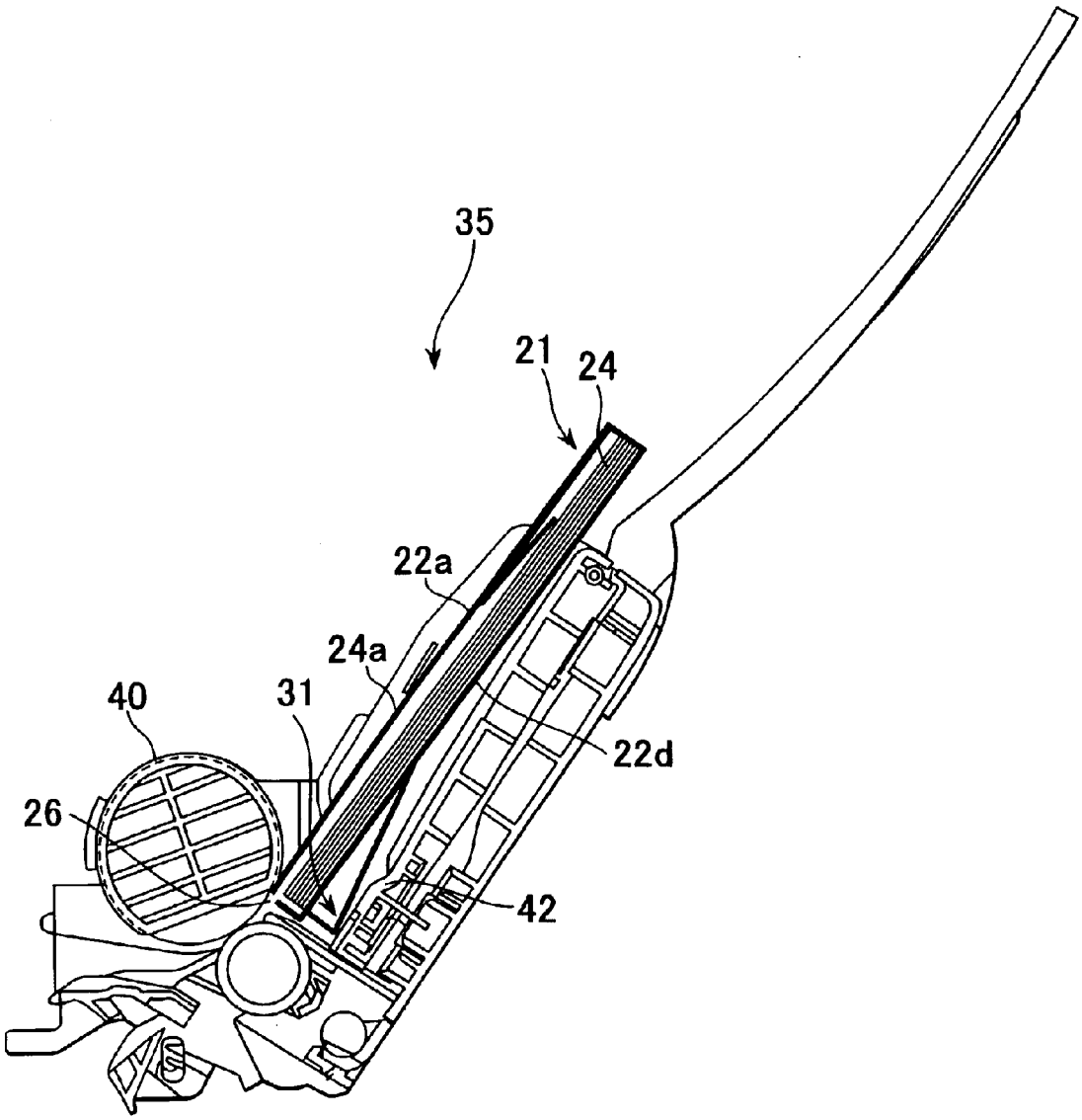
FIG. 9 is a sectional view of the feeding unit having the mediapack loaded thereon.

Next, FIG. 9 is a sectional view of the feeding unit 7 with the recording media 24 contained in the storage case 22 of the mediapack 21 and full-loaded on the loading part 35. In the same way as in the state shown in FIG. 8, when the mediapack 21 is loaded on the loading part 35, the pressure plate 42 is in the standby mode, so that the pressure is not applied to the mediapack 21, and the recording media 24 within the mediapack 21 does not abut the feeding roller 40. In this state, a user can easily attach and detach the mediapack 21 relative to the loading part 35.

In the mediapack 21 loaded on the loading part 35, the entire mediapack 21 is loaded on the pressure plate 42 by gravity while the recording media 24 are also positioned close to the bottom surface 22*b* of the mediapack 21 by gravity. Therefore, since the recording media 24 are not positioned at a position facing the clearance 26, the recording media 24 are stable within the mediapack 21 without running off the mediapack 21.

In the mediapack 21, following the rotation of the pressure plate 42, the projection 31 abutting the pressure plate 42 moves from the bottom surface 22*b* of the storage case 22 toward the top surface 22*a* against gravity. The movement of the projection 31 moves the top 24*a* of the recording media 24 to a position facing the clearance 26 for the first time, enabling the recording media 24 to be brought outside the mediapack 21.

That is, according to the present invention, it is a necessary condition associated with the gravitational force that the feeding roller 40 and the clearance 26 be arranged near the top surface 22*a* of the mediapack 21 while the projection 31 of the movable plate 23 be arranged near the bottom surface 22*b* of the mediapack 21.

Figure 10:
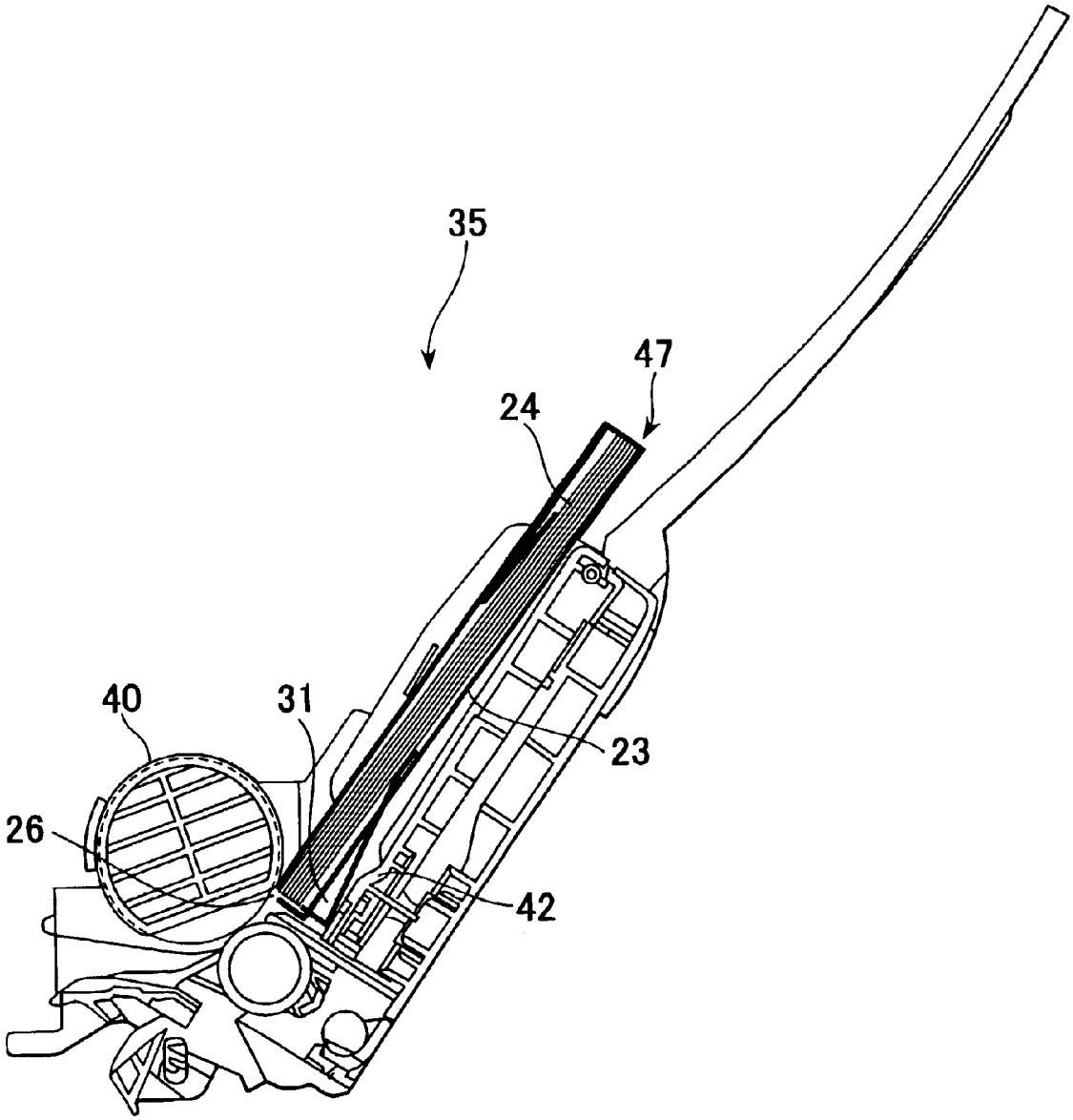
FIG. 10 is a sectional view of the feeding unit having recording media fully loaded thereon showing a starting state of feeding the mediapack.

FIG. 10 shows the initiated state of the feeding operation in that the recording media 24 are abutted against the feeding roller 40 by the rotating pressure plate 42 under a predetermined pressure. The pressure plate 42 constitutes a system to push up the recording media 24 via the movable plate 23 so as to abut against the feeding roller 40 by transferring the urging force to the projection 31. Since one end of the movable plate 23 is freely foldable (arrow d direction in FIG. 11) via a hinge 47, the inclination angle relative to the bottom surface 22*b* of the storage case 22 can be changed corresponding to the recording media 24 remaining in the mediapack 21.

Figure 11:
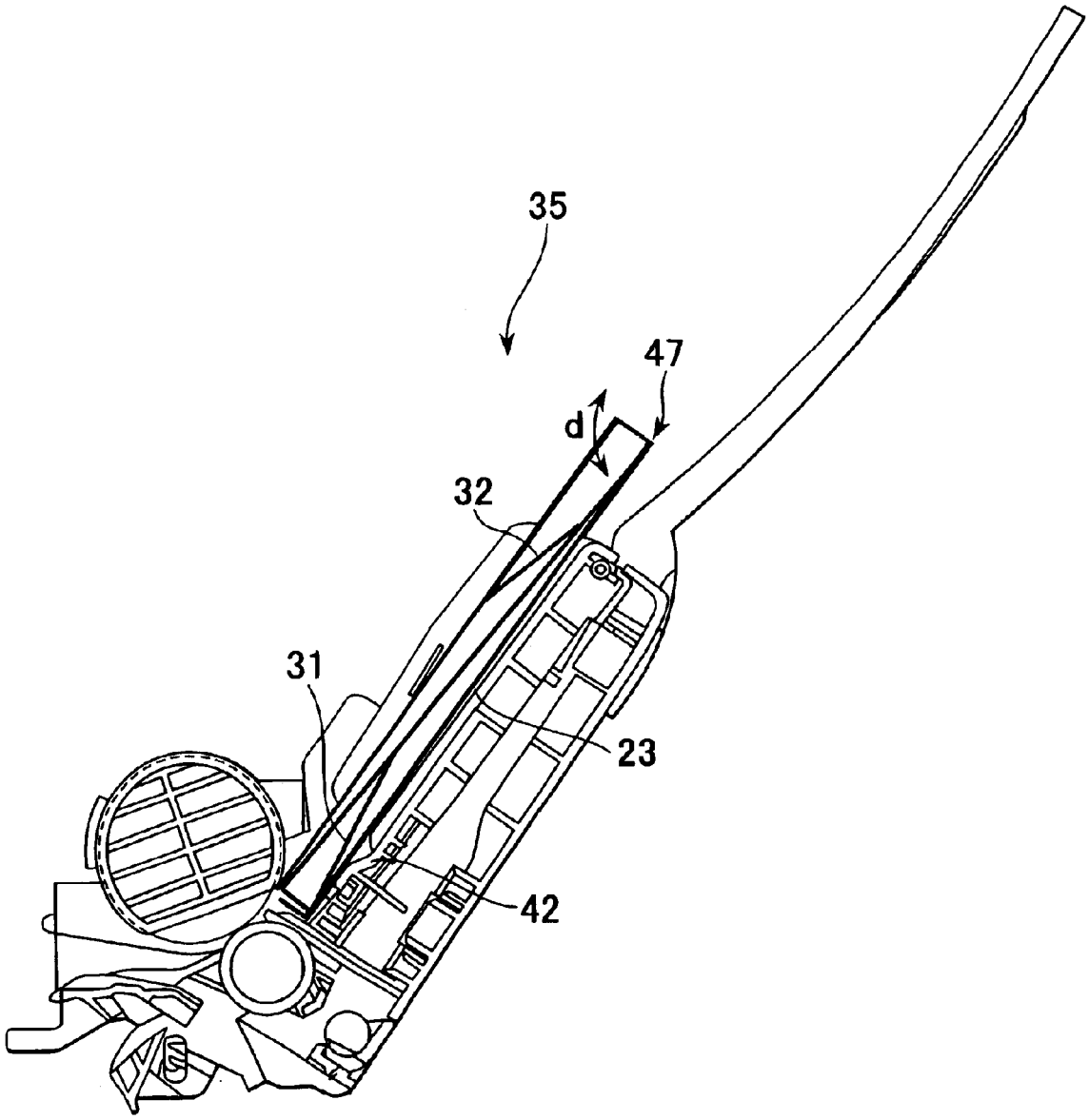
FIG. 11 is a sectional view of the feeding unit having one recording medium contained in the mediapack loaded thereon showing a starting state of the feeding operation.

FIG. 11 shows the initiated state of the feeding operation when the remaining number of the recording media 24 is one sheet. As shown in FIG. 11, since along with the reduction in the remaining number of the recording media 24, the total thickness of the recording media 24 is also reduced, the rotational angle of the pressure plate 42 is increased while the inclination angle of the movable plate 23 is increased along therewith.

Figure 12:
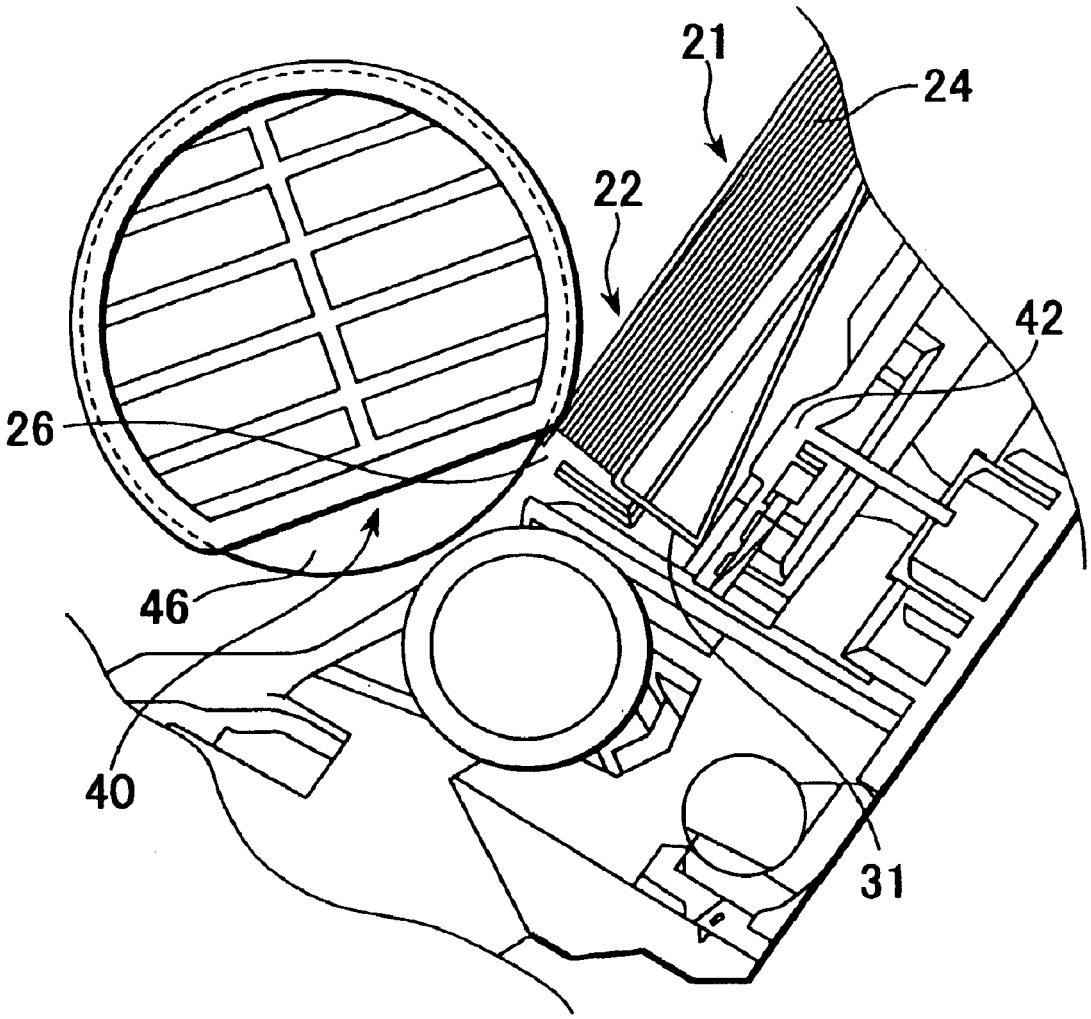
FIG. 12 is a sectional view for illustrating the essential part of FIG. 10.
Figure 13:
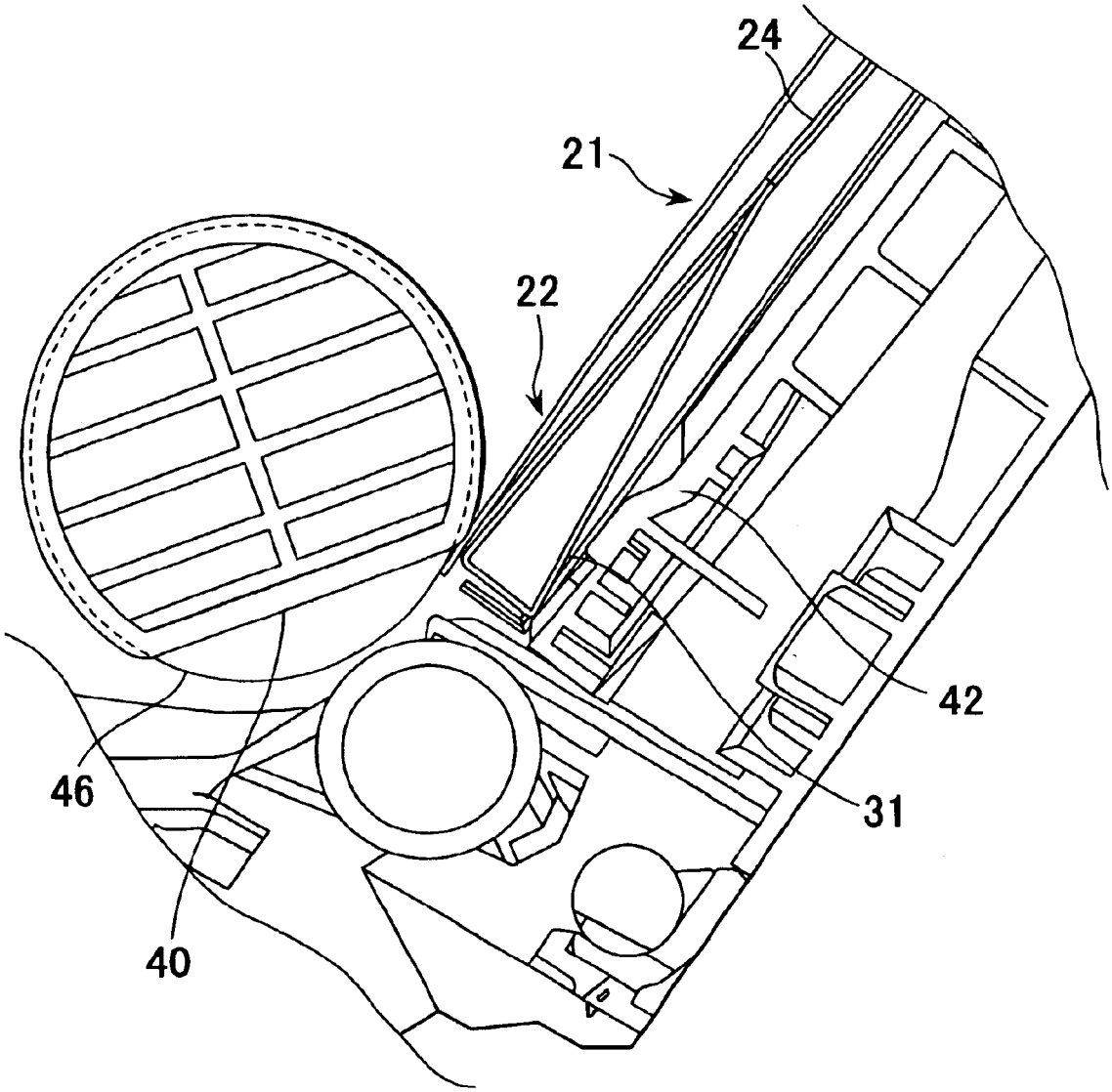
FIG. 13 is a sectional view for illustrating the essential part of FIG. 11.

The state shown in FIGS. 10 and 11 will be described more in detail with reference to FIGS. 12 and 13. FIG. 12 corresponds to FIG. 10; FIG. 13 corresponds to FIG. 11.

As described above, the external periphery of the feeding roller abuts the recording media 24 within the mediapack 21. The feeding roller 40 is formed to have a substantially demilunar-shape by cutting off part of the external periphery, and made of a material having a high friction coefficient relative to the recording media 24, such as rubber.

Referring back to FIG. 6, the feeding shaft 41 is provided with circular ribs 46 for preventing the mediapack 21 from floating relative to the pressure plate 42, the ribs 46 being arranged at a plurality of positions at predetermined intervals in the axial direction. These ribs 46 are arranged integrally with the feeding shaft 41 so as to rotate integrally with the feeding roller 40. The external diameter of the rib 46 is slightly smaller than that of the feeding roller 40, and the difference in radius between the rib 46 and the feeding roller 40 is about the sheet thickness of the storage case 22 plus 0.5 mm: e.g., if the sheet thickness is 0.5 mm, the difference in radius may preferably be 1.0 mm. The ribs 46 are located at positions abutting the storage case 22, and prevent the entire mediapack 21 from moving toward the feeding roller 40 when the movable plate 23 is elevated toward the top surface 22*a* of the storage case 22. In order to locate the top 24*a* of the recording media 24 at the clearance 26, by means of the difference in radius mentioned above, the recording media 24 are pushed to the feeding roller 40 under an appropriate pressure. This function, as shown in FIGS. 12 and 13, is the same even when the remaining numbers of the recording media 24 are changed.

In such a manner, since the external diameter of the ribs 46 is smaller than that of the feeding roller 40, in the case where the naked recording media 24 not contained in the mediapack 21 are fed, the feeding roller 40 abuts the top 24*a* of the recording media 24 in advance so that the rotation of the pressure plate 42 is stopped at this time. Therefore, the ribs 46 do not abut the naked recording media 24 so that any bad effect is not encountered. That is, the ribs 46 for preventing the pack from floating function only during using the mediapack 21.

As shown in FIG. 13, since the pressing force of the pressure plate 42 is required to transfer to the feeding roller 40 via the last one sheet of the recording media 24, the projection 31 has a projecting dimension in the thickness direction substantially equal to or slightly larger than the thickness of the mediapack 21. Although the larger projecting dimension of the projection 31 does not interfere with the function, the larger dimension makes the entire thickness of the mediapack 21 large to have difficulty in handling, so that the dimensional relationship mentioned above may be preferable.

The ribs 46 for preventing the pack from floating, as shown in FIG. 6, are arranged at three positions in the width-wise direction of the recording media 24. Since plural kinds of the mediapack having different widths corresponding to the sizes of the recording media 24 (the L-form, the double L-form, and the postcard form, for example) are attached, these ribs 46 are located at positions corresponding to the ends of each mediapack in the widthwise direction.

In the case where additional kinds of the mediapack are incorporated, that can be achieved simply by arranging another rib at a position corresponding to that of the additional kind pack, so that it is not obviously limited to the three positions mentioned above. Moreover, the rib 46 can be molded integrally with the feeding shaft 41 by a resin material, so that the ribs 46 can be achieved substantially without increasing the manufacturing cost. The ribs 46, of course, may be separately made so as to rotate freely from the feeding shaft 41. According to the embodiment, the external periphery of the rib 46 is circular; it may be the same as that of the feeding roller 40 (a substantially demilunar-shape) so as to function only at the time in the required phase. The external periphery of the rib 46 slides against the external periphery of the storage case 22, but it can have a sufficiently small friction coefficient, so that the rib 46 can be excellently operated whether it is integral or separated.

The returning mechanism mentioned above functions in the case where the mediapack 21 is loaded on the loading part 35 in the same way as that of the naked recording media 24, so that several sheets of the recording media 24 that have passed through the clearance 26 are fed to the nip so that only one sheet is separated, then, the remaining recording media 24 are returned into the mediapack 21 by the returning mechanism.

That is, the feeding unit 7 according to the present invention feeds the recording media 24 from the mediapack 21 using the separating mechanism and the returning mechanism, which are the basic structure of the conventional feeding unit to feed one sheet of naked recording media at a time.

Next, specification identifying means for identifying the specification of the mediapack 21 will be described with reference to FIG. 1. In the feeding unit 7, a sensor 50 for specification identifying is arranged at a position opposing the identification mark 28 of the mediapack 21 loaded on the loading part 35. This sensor 50 has four optical reflection sensor elements corresponding to the four bits of the identification mark 28 so as to be read out by the control system 9 at predetermined periodic intervals (every one second, for example). Therefore, by the sensor 50, the presence and the specification of the mediapack 21 can be identified.

When the mediapack 21 having the identification mark 28 arranged in the order of black, white, black, and white printed thereon is loaded, the feeding unit 7 can identify the mark 28, so that media information about the sheet type such as super glossy, glossy, and mat, and the sheet size such as the L-form, the double L-form, and the postcard form, can be detected. By feeding the media information to the host computer 400 from the sensor 50, data processing, such as image data, and a recording method are automatically selected and set corresponding to the specification of the mediapack 21 loaded thereon.

The sensor 50 is exemplified by an example using four reflection sensor elements; alternatively, an arrangement may be adopted in that one reflection sensor element reads the four bits by scanning; the number of bits is not limited to the four and may obviously be increased or decreased on demand. Also, the reader is not limited to the optical reflection type and another type such as a magnetic type or a radio-wave type may be used. Although not shown, an arrangement may be adopted in which the mediapack has a memory element such as nonvolatile memory (ROM) so as to be electrically connected to the recording unit 2 for gathering stored information.

The scheme of the identification symbol 29 mentioned above will be described in detail. An example of a setting screen according to the embodiment is shown in FIG. 14, in which in addition to a setting screen of a printer driver of a general PC, the functions according to the present invention are added.

Figure 14:
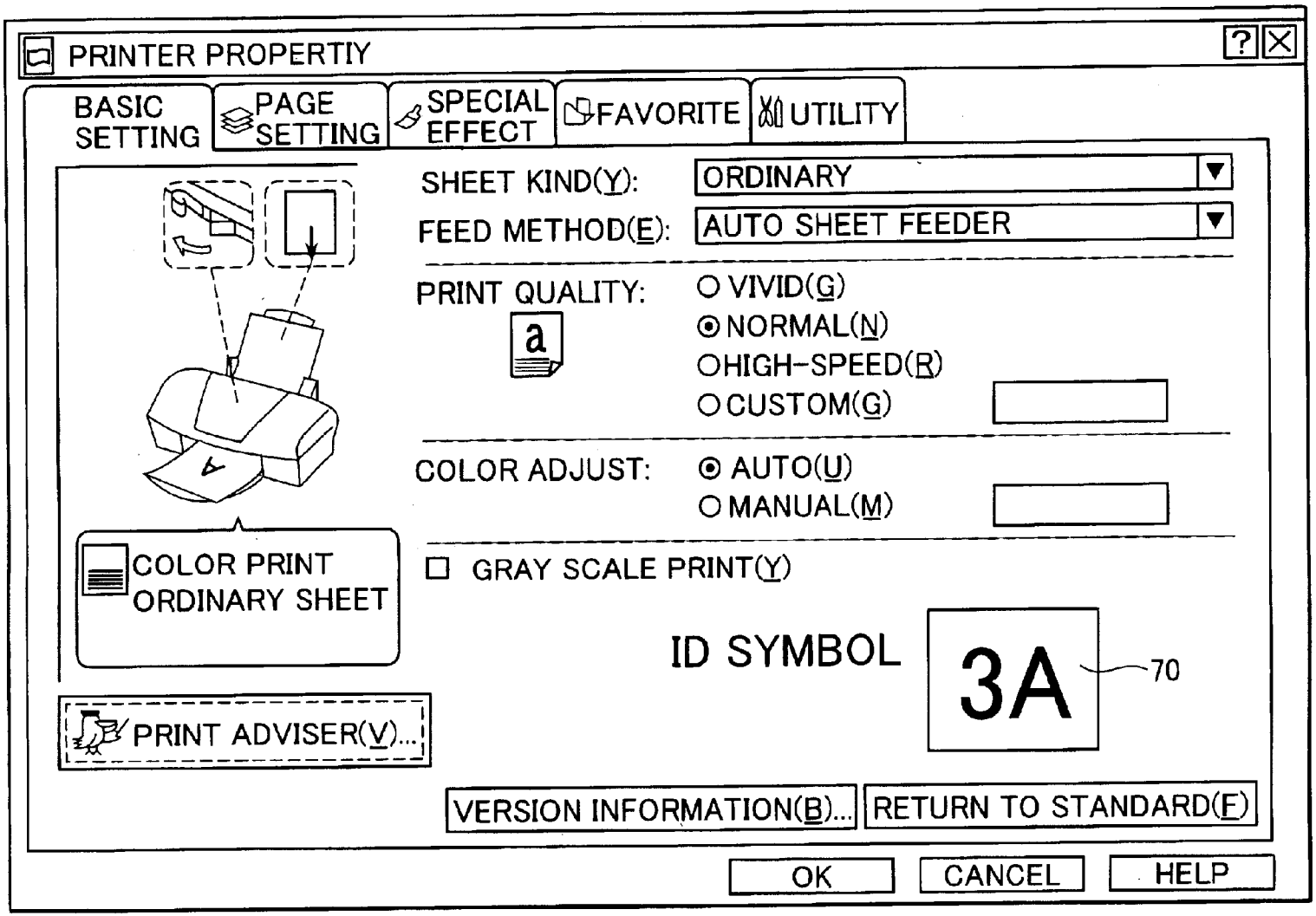
FIG. 14 is a drawing of a setting screen of a printer driver according to the present invention.

As shown in FIG. 14, on the setting screen, there is provided a section 70 for inputting the identification symbol 29 printed on the mediapack 21. In the printer 1 having the specification-identifying sensor 50, when the mediapack 21 is loaded on the feeding unit 7, the sensor 50 reads out the identification symbol 29 periodically. Accordingly, the printer 1 automatically detects the loading of the mediapack 21 and feeds media information to the host computer 400 so as to automatically display the identification symbol 29 such as "3A" in the section 70 on the setting screen of the printer driver.

The mediapack is consumable, so that it is preferable that one kind of the mediapack can be used in a plurality of models of the printer. The printer is normally provided in a series of plural models from high-order to low-order model according to the price. In the high-order model, a printer may have the specification-identifying sensor 50 to be a product capable of automatically identifying both the presence and the kind of the mediapack (first printer). The structure of the first printer is the same as in the printer 1.

On the other hand, in the medium-order model, a printer may have only one reflection sensor, and it is supposed to be a product capable of identifying only the presence of the mediapack and not identifying the specification thereof (second printer).

Furthermore, in the low-order model, a printer has not the reflection sensor at all so as not to identify both the presence and the kind of the mediapack (third printer), which is assumed to be necessary in view of manufacturing cost.

In each of three kinds of high-order, medium-order, and low-order models, the arrangement of the sensor is only different and the other arrangements are the same as the printer 1, so that the feeding operation can be respectively performed on both naked recording media not contained in the mediapack 21 and the recording media 24 contained in the mediapack 21.

In the second and third printers, which are respectively the medium-order and low-order models, the detected result by the specification-identifying sensor is not displayed in the section 70 on the setting screen of the printer driver shown in FIG. 14. In this case, a user may visually read the identification symbol 29 such as "3A" printed on the storage case 22 so as to manually input it in the PC by one's self.

In the conventional setting screen of the printer driver, at least two settings of the sheet kind and the size have to be manually input, whereas according to the present embodiment, only one setting is needed. Because the media information is simply symbolized, the setting is easier and simpler in comparison with the case in which the kind and size of the loaded recording media 24 are checked and input by a user oneself. This makes the select and setting of the kind and size of the recording media 24 difficult to be mistaken.

In the second printer, which is the medium-order model, because the presence of the loaded mediapack 21 can be detected, the wrong operation, in which the recording is started in the non-input state in the section 70, may also be prevented by assembling a sequence into the printer driver for prompting a user to perform input operation in the section 70 when the mediapack 21 is detected, for example.

Figure 15:
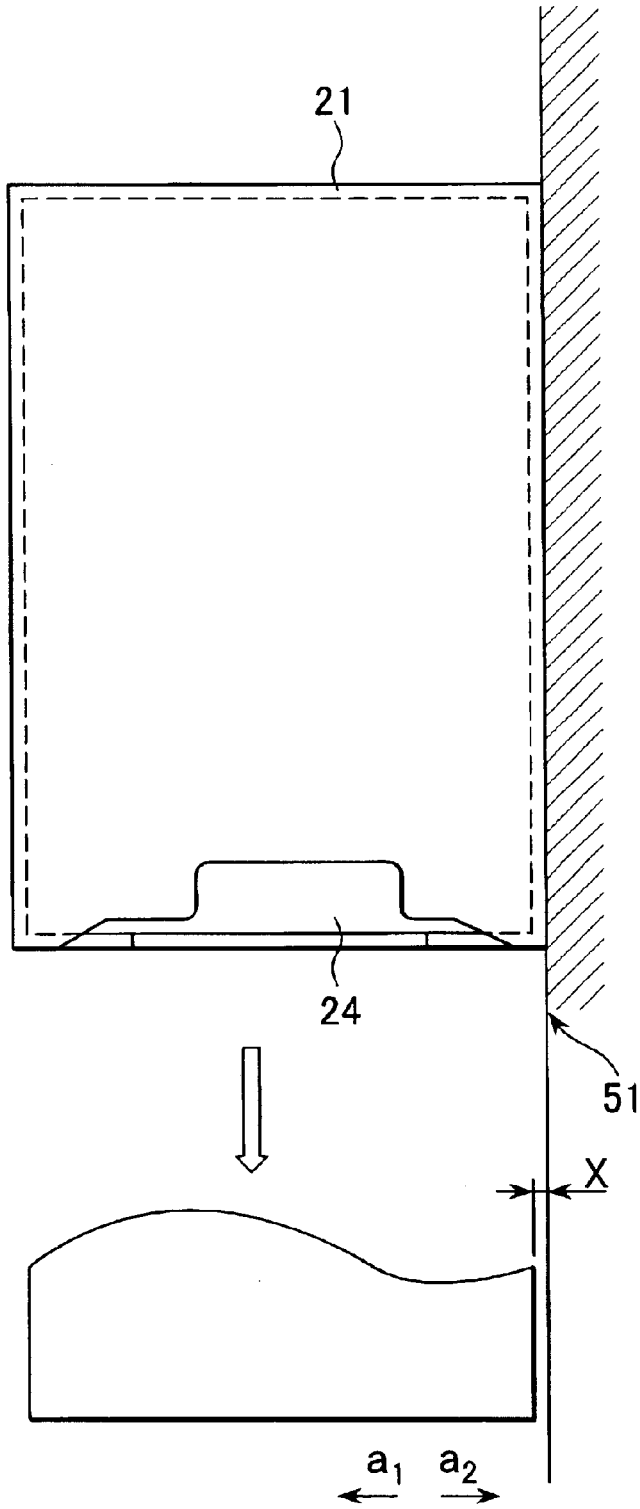
FIG. 15 is a plan view for illustrating the position of a recording medium fed from the mediapack.

Next, the loading position of the recording media 24 fed from within the mediapack 21 will be described with reference to the drawings. As shown in FIG. 1, in the loading part 35, a reference wall 51 to be the feeding direction reference of the recording media 24 is arranged at a position opposing the side guide 43. In feeding the recording media 24 by loading the mediapack 21 on the loading part 35, as shown in FIG. 15, the recording media 24 are misaligned in the direction separating from the reference wall 51 by a dimension X that is the sheet thickness of the storage case 22.

In feeding the naked recording media 24, because the recording media 24 are fed by abutting the side end thereof against the reference wall 51, the misalignment by the dimension is not produced. Accordingly, the feeding position of the recording media 24 in the width-wise direction is different in the case that the mediapack 21 is not used (the naked recording media 24 are used) from the case that the mediapack 21 is used. Then, in the printer 1, only during using the mediapack 21, the recording position is to be displaced by the X dimension in arrow a direction of the principal scanning directions (the width-wise direction of the recording media 24). The presence of the mediapack 21 is identified by the information from the specification-identifying sensor 50, while in the printer without the sensor 50, by the information of the identification symbol 29 input in the section 70 of the printer driver operational screen.

As described above, in the printer 1 according to the embodiment, the mediapack 21 and the naked recording media 24 loaded on the common loading part 35 are respectively fed by the same feeding roller 40, so that the entire feeding unit 7 and the printer 1 can be miniaturized.

As the ribs 46 for preventing the pack from floating is provided in the feeding shaft 41 of the feeding roller 40 in the printer 1, when the mediapack 21 is loaded on the loading part 35, the relative position between the loaded storage case 22 and the feeding roller 40 is restricted by the ribs 46, so that the entire mediapack 21 can be securely prevented from floating from the pressure plate 42 of the loading part 35. Therefore, the printer 1 can separate one sheet at a time from a plurality of the recording media 24 within the storage case 22 loaded on the loading part 35 for excellently feeding it.

As the ribs 46 for preventing the pack from floating is provided in the feeding shaft 41 of the feeding roller 40 in the printer 1, the ribs 46 can be securely performed simultaneously with the feeding operation by the feeding roller 40.

According to the embodiment, as the projection 31 is provided in the mediapack 21, because the pressing force by the pressure plate 42 is transferred to the recording media 24 within the mediapack 21, the recording media 24 can be excellently fed.

According to the embodiment, as the mediapack 21 is provided with the checking claws 27 disposed at positions adjacent to the clearance 26, when the mediapack 21 is loaded on the feeding unit 7, the recording media 24 within the storage case 22 can be separated by one sheet at a time. However, when the storage case 22 is removed from the loading part 35, the recording media 24 can be securely prevented from being brought out of within the storage case 22.

According to the embodiment, while the storage case 22 is provided with media information, the printer 1 is provided with the specification-identifying sensor 50 for detecting the media information, so that the printer 1 can identify the specification of the recording media 24 within the mediapack 21. Accordingly, the printer 1 can automatically set the recording mode and image processing, for example, optimally to the recording media 24 within the mediapack 21 based on the media information of the mediapack 21.

Moreover, by displaying the identification symbol 29, which is coded media information, on the mediapack 21, a user can visually read the symbol 29 so as to manually input it on the setting screen of the printer driver, enabling the media information of the recording media 24 to be readily set. Therefore, the user can perform the optimal setting of the recording mode and image processing on the recording media 24 within the mediapack 21.

The printer 1 according to the embodiment detects the loaded mediapack 21 so as to amend the recording position according to the sheet thickness, thereby preventing the information recording difference between the naked recording media 24 and the recording media 24 contained in the mediapack 21, that is the recording positional difference relative to the end in the width-wise direction of the recording media 24, to be produced.

Therefore, in the printer 1 according to the embodiment, both the naked recording media 24 and the recording media 24 contained in the mediapack 21 can be commonly used while various settings for optimally recording information on the recording media 24 can be automatically set according to the specification of the recording media 24 without being set by a user. That is, the switching between the naked recording media 24 and the mediapack 21 can be very simply performed only by feeding the respective media into the feeding inlet, so that recording on the picture shade media and the recording on normal sheets are compatible and can be switched simply with reduced misoperation.

Furthermore, in the printer 1, the recording mode for picture shade media can be automatically or manually set while the mediapack 21 having the recording media 24 left unused can be readily removed from the loading part 35 so that the remaining recording media 24 can be stored without directly touching picture shade media with a hand and leaving fingerprints.

From the media information 24 of the mediapack 21, in the printer 1 or the printer driver, the control of the recording operation or an image processing method being optimal to the recording media 24 can be automatically set and executed.

<Second Embodiment>

Next, a printer according to a second embodiment having another feeding unit will be described. Since the printer according to the second embodiment has the same recording unit as that of the printer 1 according to the first embodiment described above, the description thereof is omitted. The printer according to the second embodiment incorporates another mediapack 62 different from the mediapack 21 applied to the printer 1 according to the first embodiment.

Figure 16:
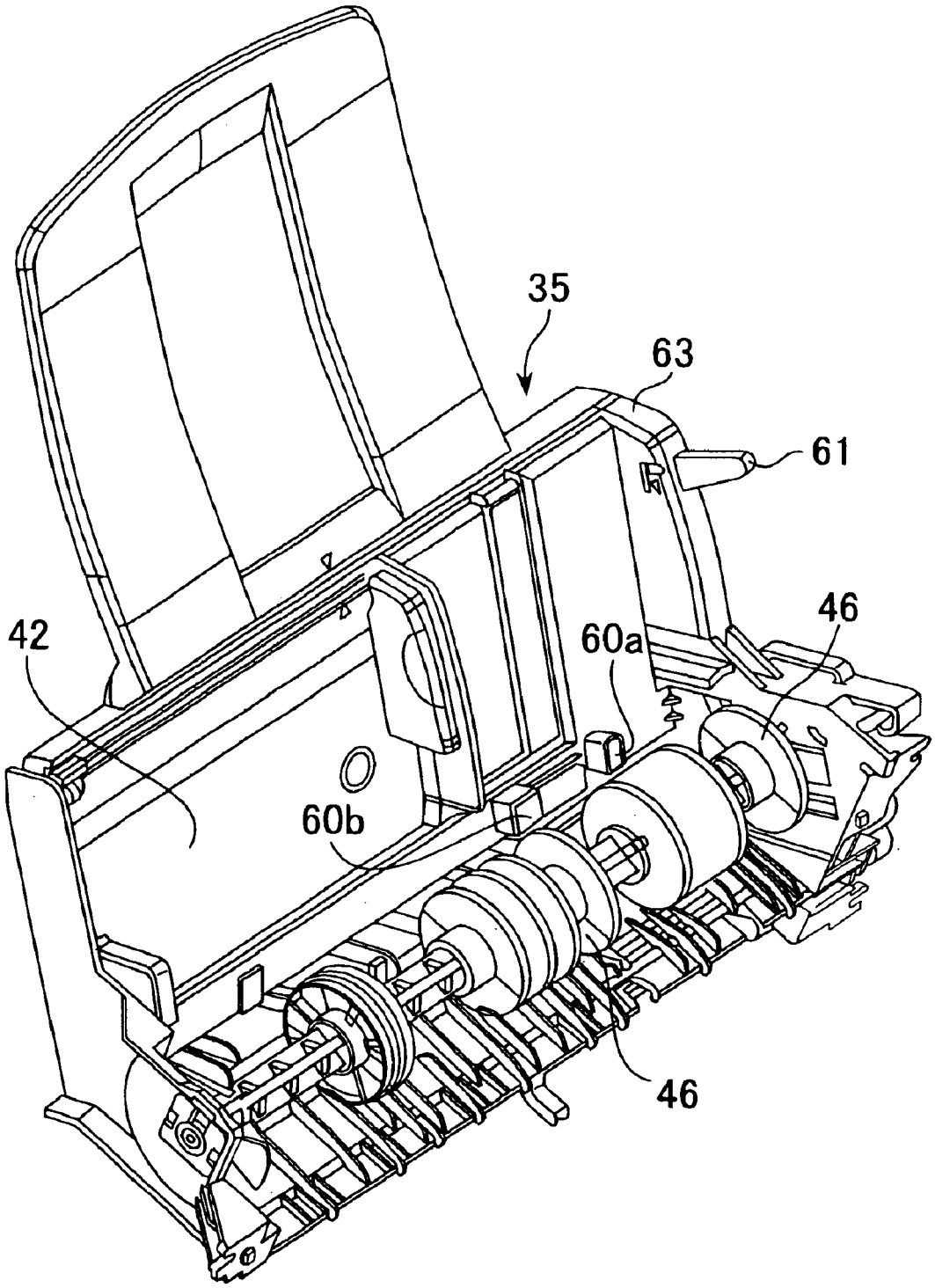
FIG. 16 is a perspective view of a feeding unit included in a printer according to a second embodiment.

As shown in FIG. 16, a feeding unit 63 included in a printer 1 according to the second embodiment comprises protruding members 60*a* and 60*b* arranged movably relative to the pressure plate 42 to be abutted against the movable plate 23 of the mediapack 62, an operating lever 61 for displacing the protruding members 60*a* and 60*b*, and a driving mechanism (not shown) for moving the protruding members 60*a* and 60*b* in conjunction with the displacement operation of the operating lever 61.

The protruding members 60*a* and 60*b* are arranged at positions opposing the movable plate 23 of the storage case 22 at a predetermined space in the width-wise direction of the recording media 24. The protruding members 60*a* and 60*b* are disposed movably between a protruded state that the end thereof protrudes from the principal surface of the pressure plate 42 and a retracted state that the end is retracted to the same plane of the principal surface of the pressure plate 42. The protruding length of protruding members 60*a* and 60*b* from the principal surface of the pressure plate 42 is substantially equalized with the protruding length of the projection 31 of the mediapack 21 described above.

The operating lever 61 is located in the vicinity of the mediapack 62 loaded on the loading part 35 to be rotationally operable. The operating lever 61 is mechanically connected to the protruding members 60*a* and 60*b* with a transmission mechanism therebetween. The other arrangements of the feeding unit 63 are substantially the same as those of the feeding unit 7, so that like reference characters designate like members and the description thereof is omitted.

Figure 17:
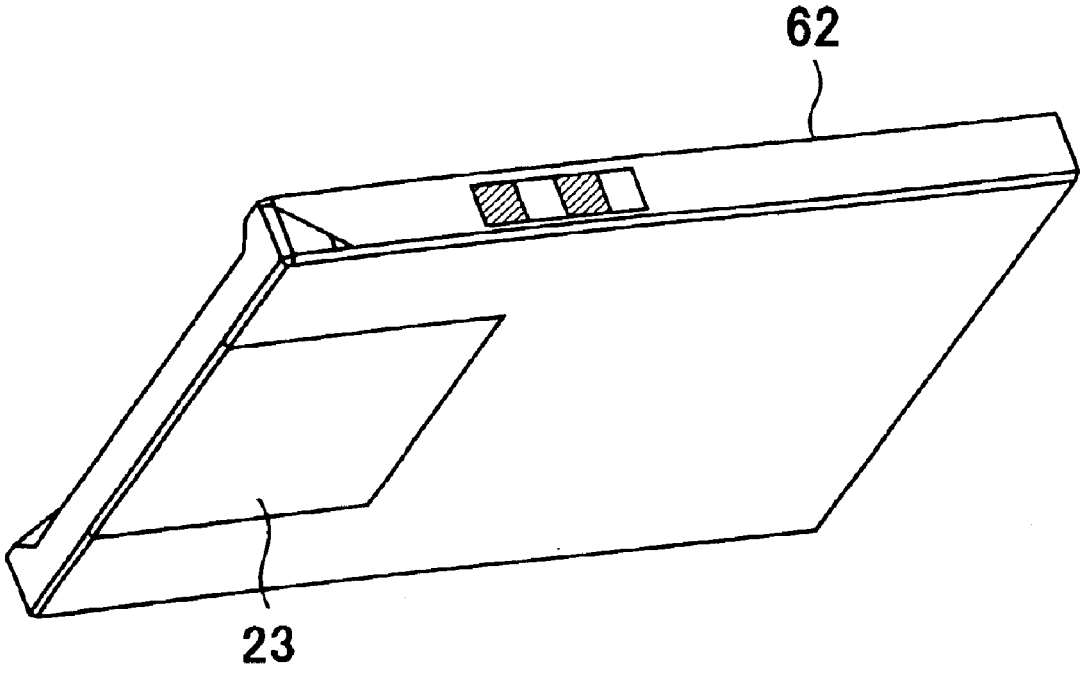
FIG. 17 is a perspective view of another mediapack incorporating the printer according to the second embodiment.
Figure 18:
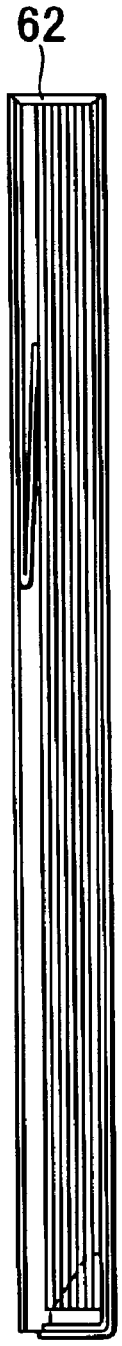
FIG. 18 is a sectional view of the other mediapack.

On the other hand, as shown in FIGS. 17 and 18, the structure of the mediapack 62 is different from the structure of mediapack 21 without the projection 31. The other structures are the same as those of the mediapack 21, so that like reference characters designate like members and the description thereof is omitted. The mediapack 62 is provided with the movable plate 23 in the same way as in the mediapack 21, and the movable plate 23 is abutted and supported to ends of the protruding members 60*a* and 60*b*.

Therefore, in the feeding unit 63 structured as above, in the case where the mediapack 62 is loaded on the loading part 35, when a user operates the operating lever 61, the protruding members 60*a* and 60*b* are moved to the protruded state in that protruding members 60*a* and 60*b* are protruded from the principal plane of the pressure plate 42 as shown in FIG. 16, so that the movable plate 23 of the mediapack 62 is supported thereto (the mode for the mediapack 62).

Also, in the feeding unit 63, in the case where the naked recording media 24 are loaded on the loading part 35, when a user operates the operating lever 61 in the reverse direction, the protruding members 60*a* and 60*b* are moved to the retracted state in that protruding members 60*a* and 60*b* are retracted inward the pressure plate 42, so that the recording media 24 are fed without being supported by the protruding members 60*a* and 60*b* (the mode for the naked recording media 24).

In such a manner, according to the feeding unit 63, even in the case where the mediapack 62 without the projection 31, because the pressing force of the pressure plate 42 is transmitted to the recording media 24 within the mediapack 62, the recording media 24 can be securely fed from the inside of the mediapack 62 in the same way as in the printer 1 according to the first embodiment being incorporated in the mediapack 21 described above. By the feeding unit 63, the structure of the mediapack is simplified.

The feeding unit 63 shown in FIG. 16 does not have the specification-identifying sensor 50; however, the sensor 50 may also be added thereto on demand. Moreover, in the feeding unit 63, when the loading of the mediapack 21 is detected by the sensor 50 or by manually inputting the identification symbol 29 in the section 70 of the setting screen of the printer driver, the protruding members 60*a* and 60*b* can also be automatically projected by the driving mechanism in the feeding unit 63.

In such a structure, the feeding unit is constituted of each component except the operating lever 61 enabling the driving mechanism to be simplified. Moreover, in such a structure, the protruding amount of the protruding members 60*a* and 60*b* is also variable, and in combination with controlling means for controlling the protruding amount corresponding to the remaining amount of the recording media 24, the containing number of the recording media in the mediapack can also be increased. When details will be described, the protruding members 60*a* and 60*b* are constructed to reduce the protruding amount when the remaining amount of the recording media 24 is large and to increase the protruding amount when the remaining amount of the recording media 24 is small. The number of the recording media 24 capable of loading on the feeding unit 63 and the thickness of the mediapack 62 have limits as a matter of course, and from the limit of the total thickness (capacity limit) during loading the mediapack, the relationship (the thickness at the capacity limit of the feeding unit 63)>(the thickness of the remaining recording media 24)+(the protruding amount of the protruding members 60*a* and 60*b*) need to be satisfied.

Therefore, when the amount of the recording media is large in the mediapack 62 (initial state), since the pressing amount of the movable plate 23 need not be increased, the protruding amount of the protruding members 60*a* and 60*b* is reduced while when the amount of the recording media is reduced in the mediapack 62, the protruding amount of the protruding members 60*a* and 60*b* is increased, so that the thickness of the recording media in the initial state can be increased provided that the thickness at the capacity limit is the same, thereby enabling the containing number of the recording media in the mediapack 62 to be increased.

An example of the structure having the two protruding members 60*a* and 60*b* has been described; alternatively, one protruding member may also be arranged substantially at the center in the width-wise direction of the recording media; or three or more protruding members may be adopted, so that it is not limited especially to two protruding members. The protruding members 60*a* and 60*b* protrude by the movement thereof; alternatively, the members may be projected by curving wire rods or by swelling a bulgy body.

<Third Embodiment>

Next, a printer according to a third embodiment will be described, which is capable of automatically setting an optimal recording method to recording media within a mediapack corresponding to media information provided in the mediapack.

Figure 19:
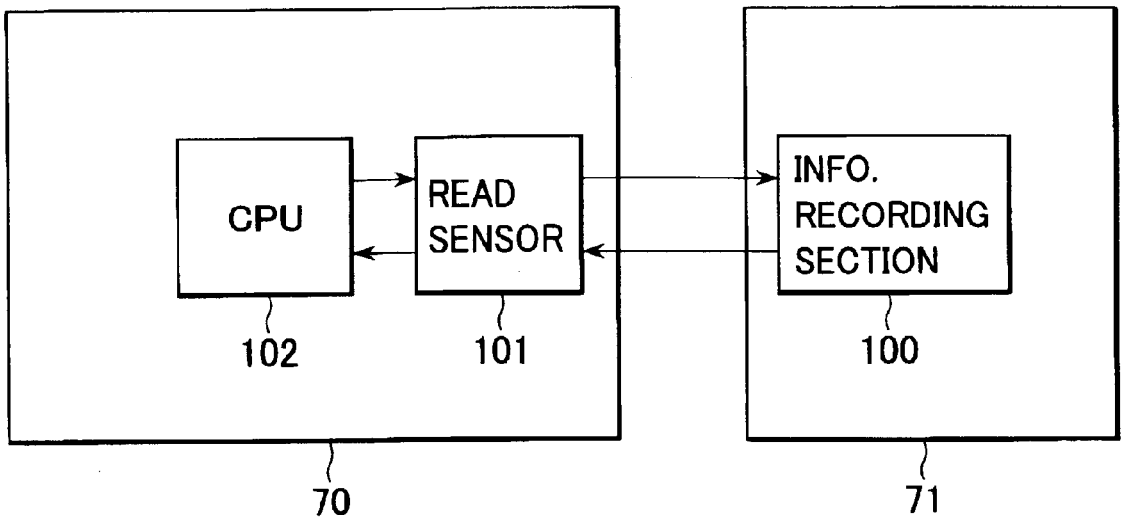
FIG. 19 is a block diagram of a printer according to a third embodiment.

FIG. 19 is a block diagram of the printer according to the third embodiment and a mediapack 71. A printer 70 internally comprises a read sensor 101 for reading media information of the mediapack 71 and a CPU 102 for controlling the read sensor 101, and the CPU 102 obtains media information from an information recording section 100 provided in the mediapack 71 via the read sensor 101.

The mediapack 71 incorporating the printer according to the embodiment is provided with the information recording section 100, in which is recorded media information such as the kind, the width or the length, the thickness, and the contained number of the recording media. The printer 70 appropriately sets the control operation of the recording unit 2 corresponding to the recording media.

As the read sensor 101, there may be the reflection sensor mentioned as the specification-identifying sensor 50 in the printer 1 and other detecting means applied thereto. As the information recording section 100, there may be an information memory element such as the identification mark 28 and a nonvolatile memory applied thereto.

The control operation automatically setting a recording mode, a feeding method, and a driving method will be described as a specific example of the control operation.

Figure 20:
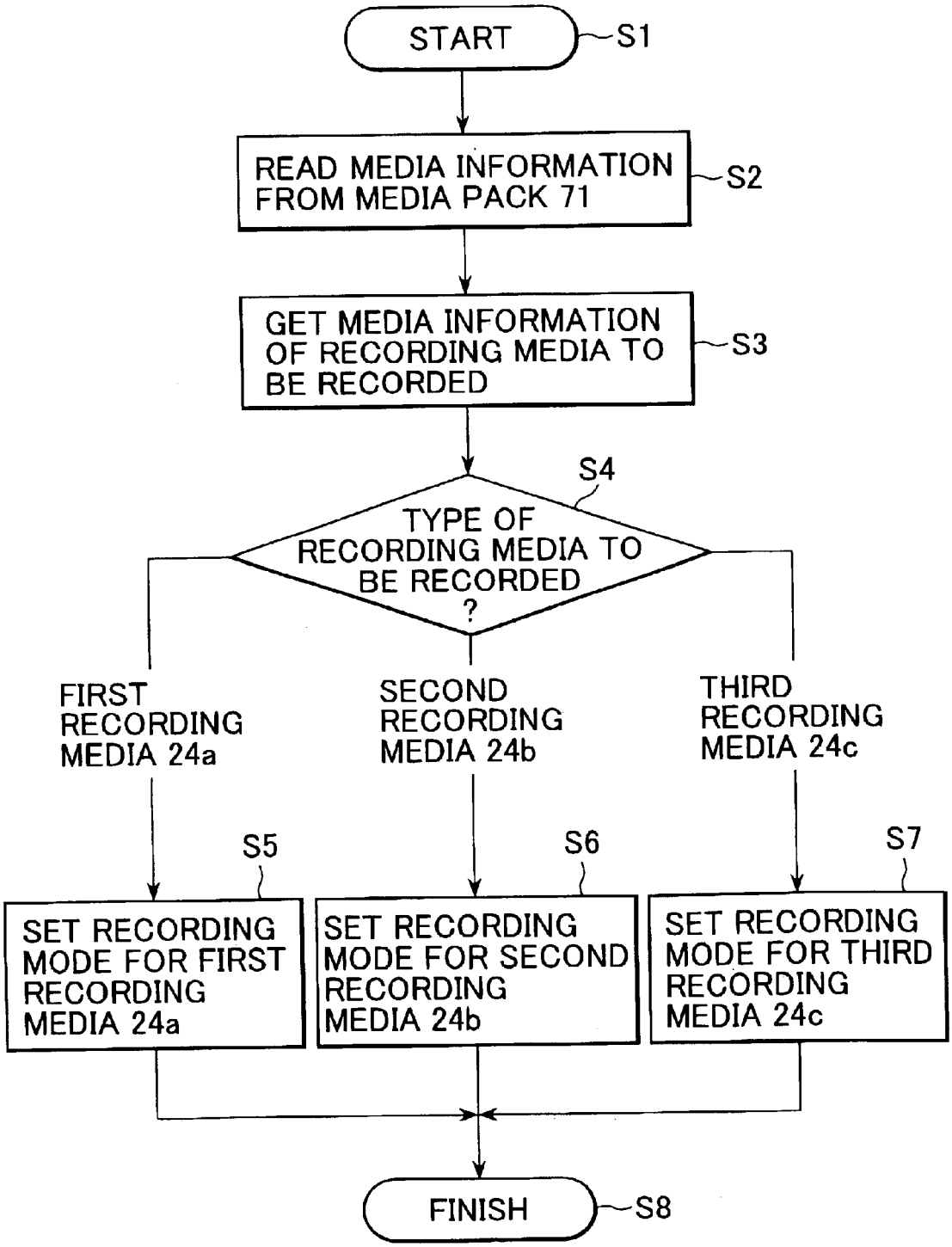
FIG. 20 is a flowchart showing an example of control operation of the printer according to the third embodiment.

FIG. 20 is a flowchart showing the automatic setting of a recording mode corresponding to the media information within the mediapack 71. By starting at step 1, as shown in step 2, the read sensor 101 has access to the information recording section 100 within the mediapack 71 so as to perform the reading operation. Then, as shown in step 3, the media information of the recording media to be recorded is obtained from the mediapack 71. Next, as shown in step 4, by identifying the specification of the recording media to be recorded, if the kind of the loaded recording media is a first recording media 24*a*, the recording mode for the first recording media 24*a* is automatically set at step 5. If the kind is a second recording media 24*b*, the recording mode for the second recording media 24*b* is automatically set at step 6. If it is a third recording media 24*c*, the recording mode for the third recording media 24*c* is automatically set at step 7. Then, a series of control flows is finished at step 8.

In such a manner, the printer 70 can automatically set the respective recording modes individually corresponding to the media information of the recording media to be recorded. According to this control flow, it is not necessary that a user manually set an appropriate recording mode in accordance with the loaded recording media purposely, so that by only loading the mediapack 71, the recording mode optimal to the recording media contained in the mediapack 71 can be automatically set by the printer 70.

Three kinds of the recording media have been exemplified; any number of kinds may of course have the same effect. In accordance with the number of kinds of the recording media, each control flow may be assembled therein after the specification of each recording media is identified. Also, the recording media corresponding to the mediapack may be one kind, and the same effect may be achieved only by identifying whether naked recording media are recorded by the normal feeding method or the recording media fed from the inside of the mediapack are recorded.

Figure 21:
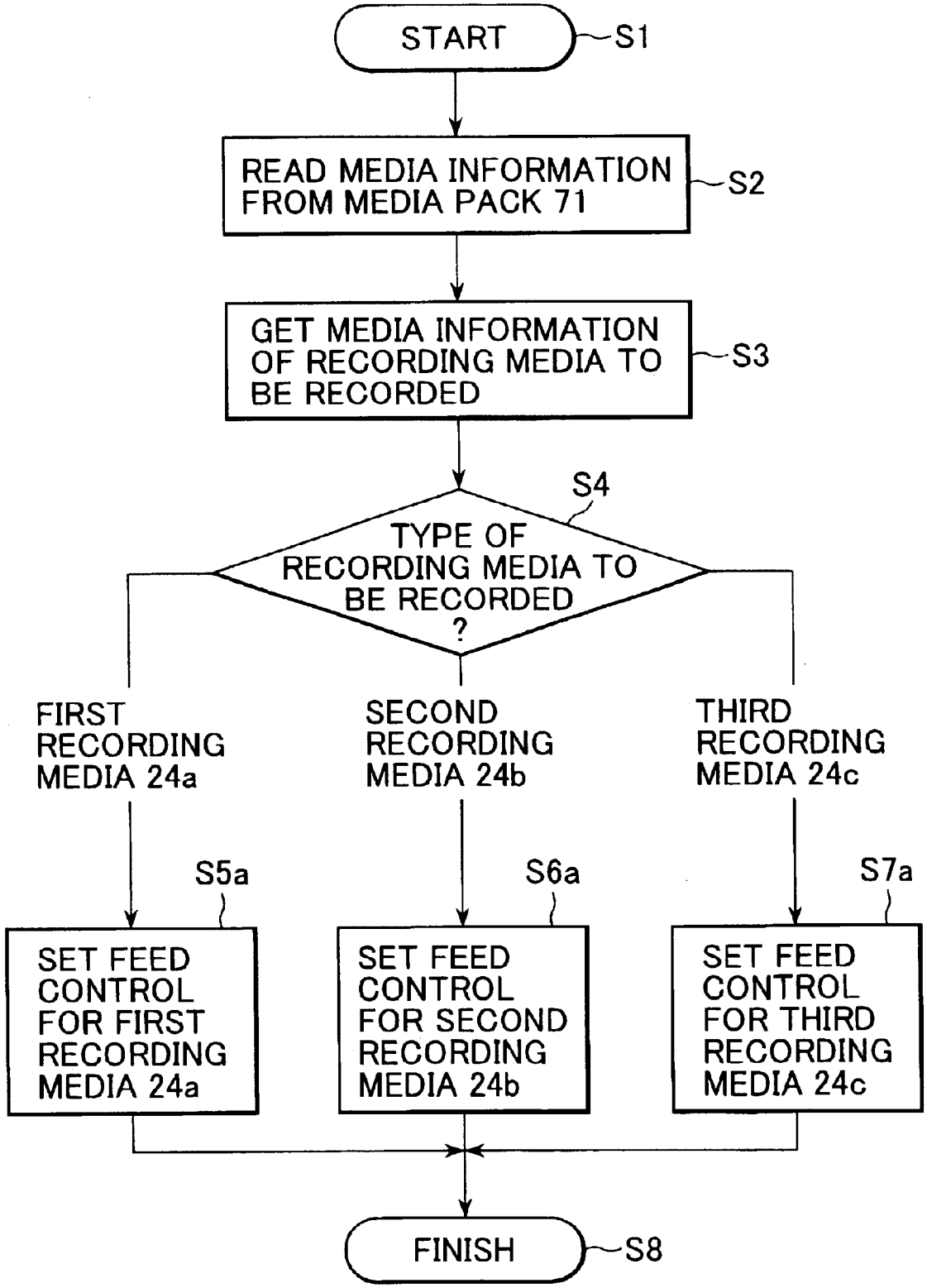
FIG. 21 is a flowchart showing another example of control operation of the printer according to the third embodiment.

FIG. 21 is a flowchart showing the control operation of the automatic setting of a feeding method corresponding to the media information within the mediapack 71. The basic control flow in the control operations shown in FIG. 21 is the same as the flowchart shown in FIG. 20, so that for convenience, like reference characters designate like members and the description thereof is omitted.

At step 3 shown in FIG. 21, by identifying the specification of the recording media to be recorded, if the kind of the recording media is the first recording media 24*a*, the control about a feeding method (feeding control) for the first recording media 24*a* is automatically set at step 5*a*. If it is the second recording media 24*b*, the feeding control for the second recording media 24*b* is automatically set at step 6*a*. If it is the third recording media 24*c*, the feeding control for the third recording media 24*c* is automatically set at step 7*a*. In such a manner, the printer 70 can automatically set the respective appropriate feeding controls individually corresponding to the media information of the recording media to be recorded.

Figure 22:
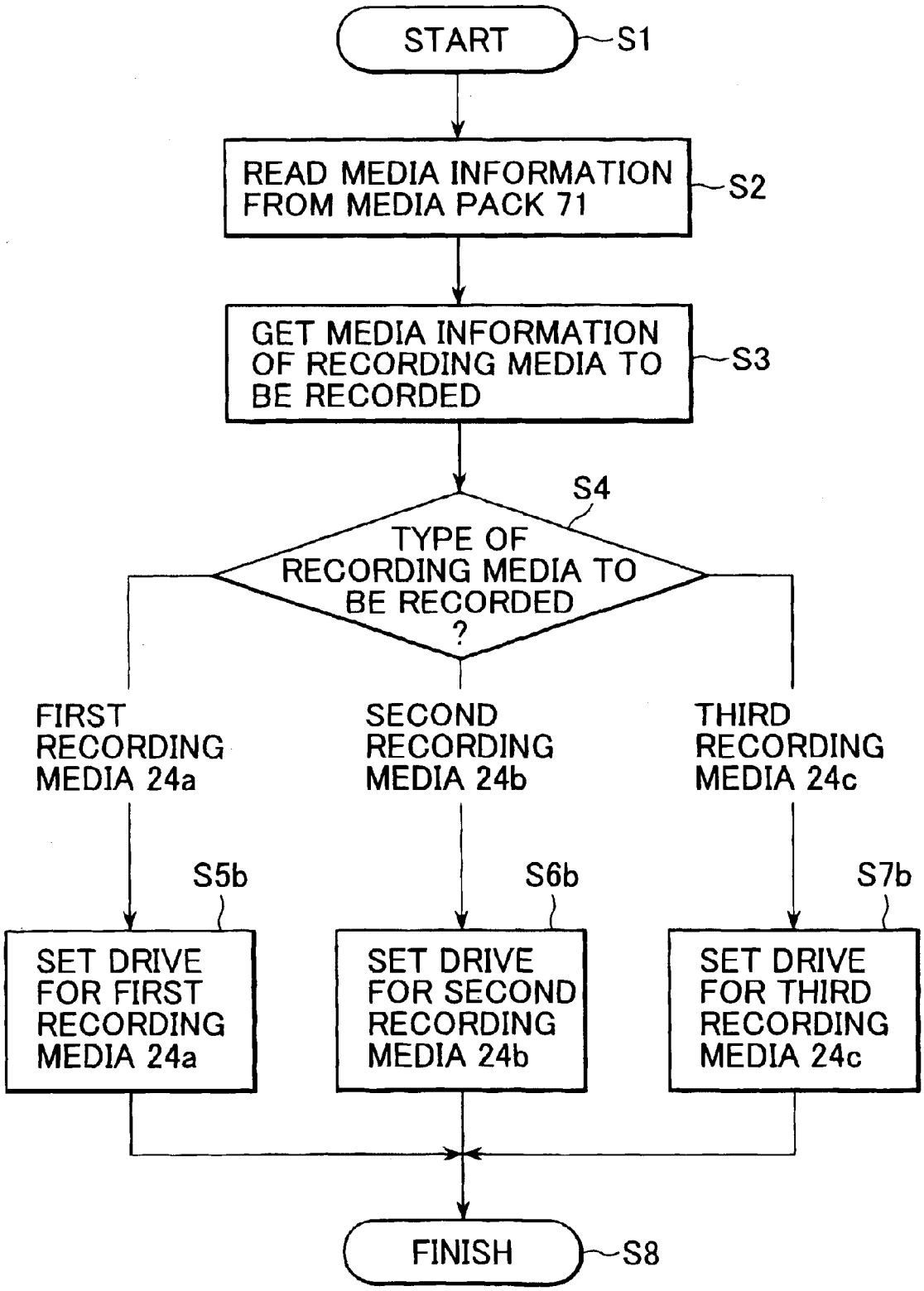
FIG. 22 is a flowchart showing still another example of control operation of the printer according to the third embodiment.

FIG. 22 is a flowchart showing the control operation of the automatic setting of a driving method corresponding to the media information. The basic control flow is the same as the flowchart shown in FIG. 20. At step 3 shown in FIG. 22, by identifying the specification of the recording media to be recorded, if the kind of the recording media is the first recording media 24*a*, the control about a driving method (driving control) for the first recording media 24*a* is automatically set at step 5*b*. If it is the second recording media 24*b*, the driving control for the second recording media 24*b* is automatically set at step 6*b*. If it is the third recording media 24*c*, the driving control for the third recording media 24*c* is automatically set at step 7*b*. In such a manner, the printer 70 can automatically set the respective appropriate driving controls individually corresponding to the media information of the recording media to be recorded.

Figure 23:
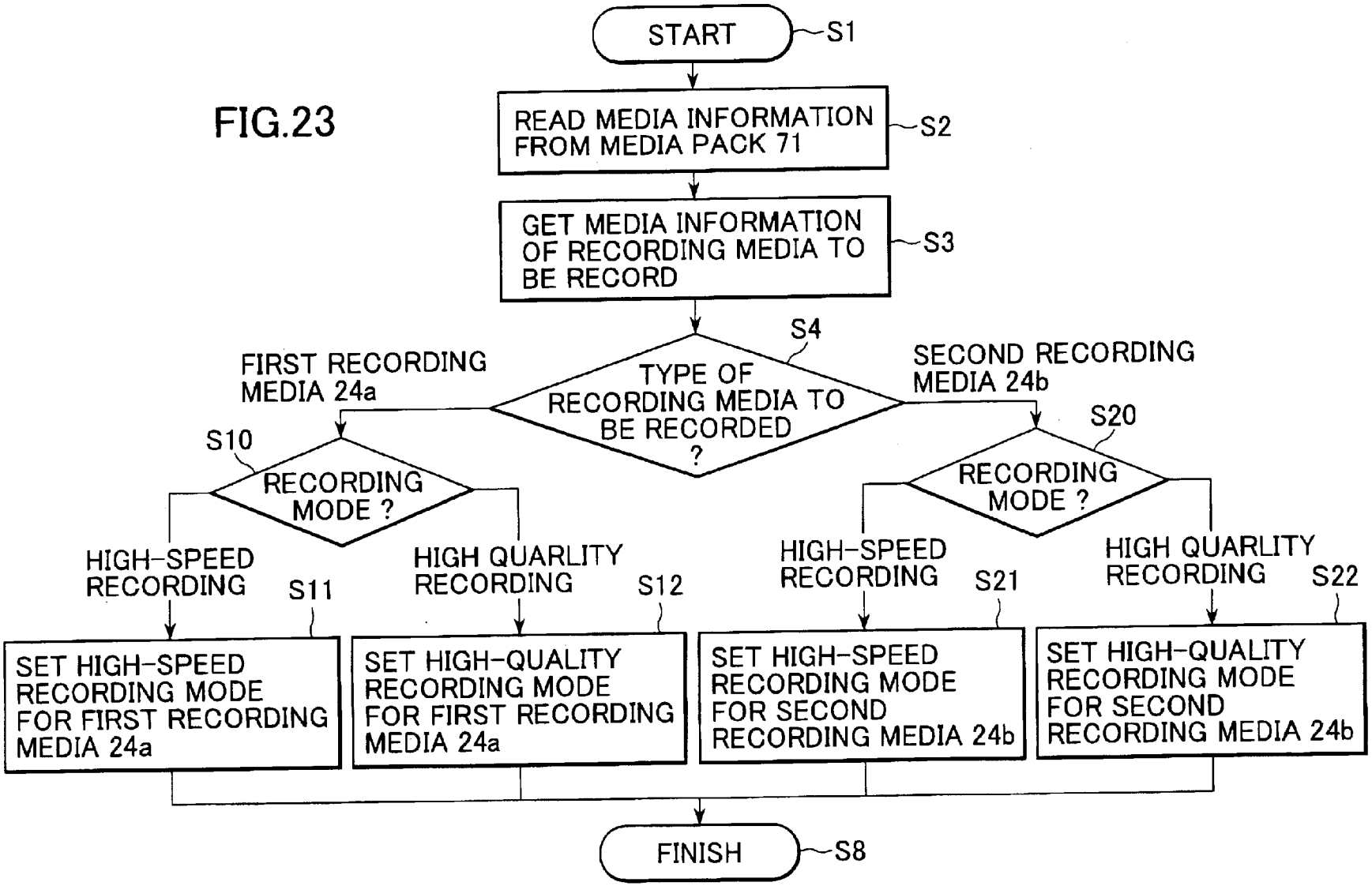
FIG. 23 is a flowchart showing still another example of control operation of the printer according to the third embodiment.

Furthermore, FIG. 23 is a modified flowchart showing the control operation of the automatic setting of a recording mode corresponding to the media information.

The recording characteristics generally required (the recording speed and image quality are focussed here) may be different corresponding to the particular user's applications. For example, business-oriented products may demand very high speed; home-oriented products may demand a certain level of image quality; and professionals may demand the maximum degree of image quality. Therefore, in the printer 70 according to the embodiment, two recording modes of the high speed recording and the high quality recording are selectable.

FIG. 23 is a flowchart showing the control operation of the automatic setting of a recording mode corresponding to the media information.

As shown in FIG. 23, by starting at step 1, by accessing the information recording section 100 within the mediapack 71, reading operation is performed at step 2. Then, at step 3, the media information of the recording media to be recorded is obtained from the mediapack 71.

Next, at step 4, by identifying the specification of the recording media to be recorded, if the kind of the loaded recording media is the first recording media 24*a*, the recording mode is automatically set at step 10. In the printer 70, the recording mode selected and set by a user in advance to be any one of "high speed recording" and "high image quality recording" is stored. This recording mode is selected at step 10. If it is the high speed recording, the high speed recording mode for the first recording media 24*a* is automatically set at step 11. If it is the high image quality recording, the high image quality recording mode for the first recording media 24*a* is automatically set at step 12.

Similarly, at step 4, by identifying the specification of the recording media to be recorded, if the kind of the recording media is the second recording media 24*b*, at step 20, the same recording mode as at step 10 is automatically selected. If it is the high speed recording, at step 21, the high speed recording mode for the second recording media 24*b* is automatically set. If it is the high image quality recording, the high image quality recording mode for the second recording media 24*b* is automatically set at step 22.

In such a manner, plural recording modes suitable for the respective purposes can be individually set corresponding to the media information of the recording media to be recorded. According to this control flow, it is not necessary that a user manually set an appropriate recording mode in accordance with the loaded recording media purposely, so that after setting any one of "high speed recording" and "high image quality recording", by only loading the mediapack 71 in the printer, the recording mode being optimal to the recording media contained in the mediapack 71 and also agreeing with the user's demand can be automatically set by the printer 70.

As described above, according to the printer 70 of the embodiment, the recording can be performed by automatically setting the control method optimal to the loaded mediapack 71. That is, the appropriate recording mode, the feeding method, and the control method corresponding to the characteristics of the respective recording media can be automatically set, so that optimal recording can be performed readily and securely without the manual setting performed by a user about the media information of the recording media. Thereby, an excellent user-friendly printer can be provided.

<Fourth Embodiment>

Next, a printer and a printer driver system according to a fourth embodiment will be described, which are capable of automatically setting a data processing method for processing data to recording media within a mediapack corresponding to media information provided in the mediapack.

Figure 24:
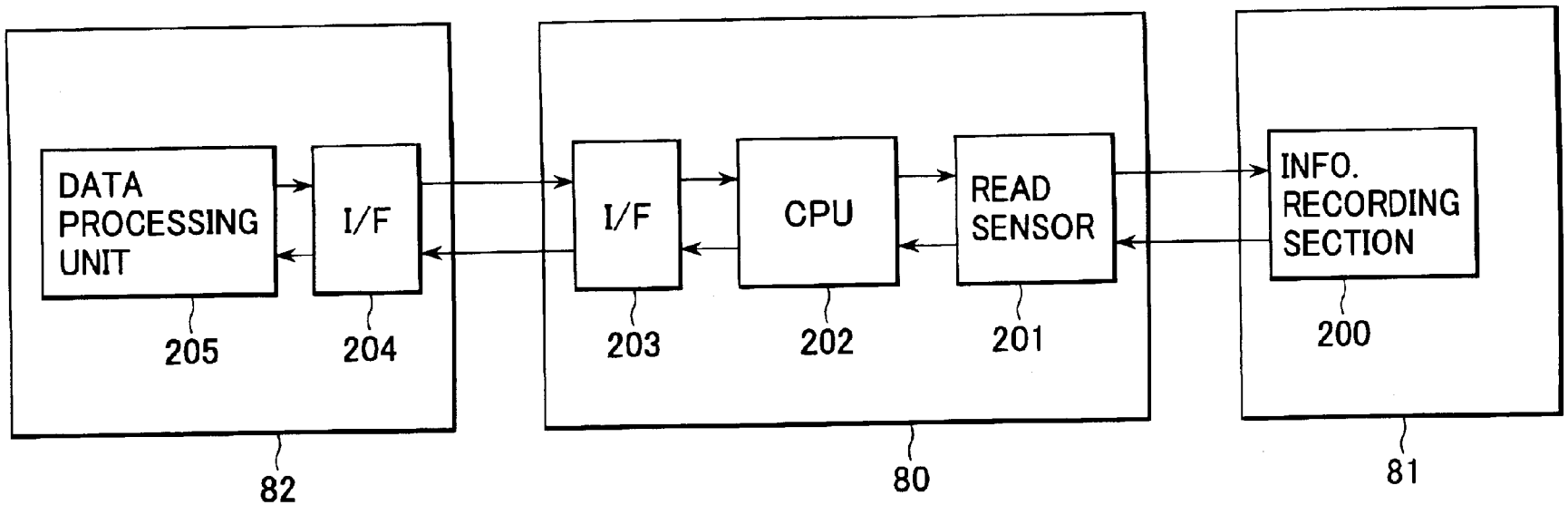
FIG. 24 is a block diagram of a printer and a printing system according to a fourth embodiment.

FIG. 24 is a block diagram of a mediapack 81, a printer 80, and a printer driver system 82 having a printer driver according to the present invention. A printer driver may be generally used by installing into an OS (operating system) of a host computer. The printer driver may also be installed into a recording unit of a printer as a data processor. According to the embodiment, the flow of media information between the printer driver system 82 including a host computer having a printer driver installed thereinto, the printer 80, and the mediapack 81 will be described with reference to the drawings.

As shown in FIG. 24, a printer 80 internally comprises a read sensor 201 for reading media information of the mediapack 81, a CPU 202 for controlling the read sensor 201, and an I/F (interface) 203 for connecting the CPU 202 to the printer driver system 82 in the host computer.

The mediapack 81 incorporating the embodiment is provided with an information recording section 200, in which recorded is media information such as the kind, the width or the length, the thickness, and the contained number of the recording media.

First, the CPU 202 in the printer 80 obtains media information from the information recording section 200 provided in the mediapack 81 via the read sensor 201. In the printer 80, the CPU 202 sends or receives the media information to or from the printer driver system 82 via I/Fs 203 and 204, and then, the media information is sent to the printer driver system 82, which is specifically the printer driver installed into a data processing unit 205.

Then, by the printer driver installed into the data processing unit 205 of the printer driver system 82, the data processing appropriate for the recording media is performed corresponding to the obtained media information.

An example of a flowchart of specific control operations for automatically setting a data processing method will be described with reference to FIG. 25.

Figure 25:
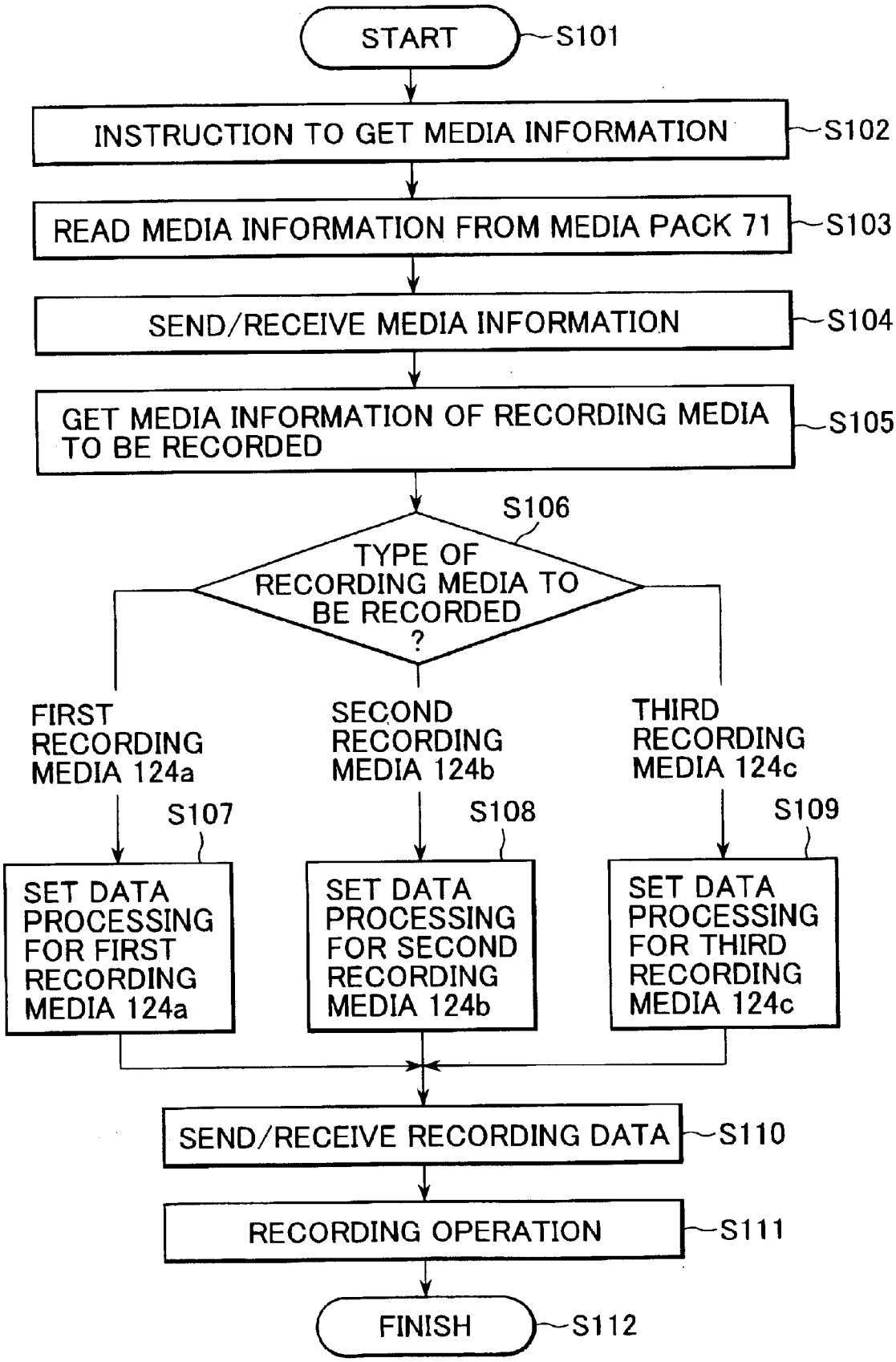
FIG. 25 is a flowchart showing an example of control operation of the printing system.

As shown in FIG. 25, by starting at step 101, an instruction of obtaining media information is originated from the printer driver system 82 at step 102, and the printer 80 receives the instruction.

Next, at step 103, the printer 80 has access to the information recording section 200 within the mediapack 81 so as to perform the reading operation. When the media information is read, in addition to the media information, the presence of the loaded mediapack 81 can also be confirmed. If the mediapack 81 is not loaded, this situation may be communicated to a user by sending it to the printer driver system 82.

The printer 80 may read media information for each instruction, or the media information may be read only when the mediapack 81 is loaded so as to store the media information in a storage medium. Next, at step 104, the printer 80 sends the media information obtained from the mediapack 81 to the printer driver system 82. At step 105, the printer driver of the printer driver system 82 obtains the media information.

Then, at step 106, by identifying the specification of the recording media to be recorded, if the kind of the recording media is a first recording media 124*a*, the data processing method for the first recording media 124*a* is automatically set at step 107. If the kind is a second recording media 124*b*, the data processing method for the second recording media 124*b* is automatically set at step 108. Further, if it is a third recording media 124*c*, the data processing method for the third recording media 124*c* is automatically set at step 109. In accordance with the respective recording media, the data processing unit 205 of the printer driver system 82 the respective data processing are executed.

At step 110, the recording data produced by the data processing unit 205 in the printer driver system 82 is sent to the printer 80 via the I/F 204, and the printer 80 receives this recording data. At step 110, based on the recording data, the printer 80 executes the recording operation so as to finish the control flow at step 112. In such a manner, according to the printer 80 and the printer driver system 82 of the embodiment, the respective data processing methods can be individually set automatically, while the recording operation is performed, corresponding to the media information of the recording media to be recorded. According to the control flow according to the embodiment, it is not necessary that a user manually set appropriate data processing in accordance with the loaded recording media purposely, so that by only loading the mediapack 81 in the printer 80, the data processing optimal to the recording media contained in the mediapack 81 can be automatically set by the printer driver system 82.

Wherein by adding media information as header information to the recording data produced by executing the data processing, the control flows shown in FIGS. 20 to 23 can be controlled from the printer driver system 82. Therefore, the printer 80 is not required to have access to the mediapack 81 for each recording operation so as to obtain media information, enabling the control load of the printer 80 to be reduced.

Moreover, three kinds of the recording media have been exemplified; any number of kinds may of course have the same effect. In accordance with the number of kinds of the recording media, each control flow may be assembled therein after the specification of each recording media is identified. Also, the recording media corresponding to the mediapack may be one kind, and the same effect may be achieved only by identifying whether naked recording media are recorded by the normal feeding method or the recording media fed from the inside of the mediapack are recorded.

As described above, according to the printer 80 of the embodiment, the recording can be performed on recording media by automatically setting the data processing method optimal to the loaded mediapack. That is, the appropriate data processing corresponding to the characteristics of the respective recording media can be automatically set, so that optimal recording can be performed readily and securely without the manual setting performed by a user about the media information of the recording media. Furthermore, by using the media information, the printer 80 also can perform the optimal control operation simultaneously. Thereby, the excellent user-friendly printer 80 and the printer driver system 82 can be provided.

As described above, according to the embodiment, the feeding by loading a storage case having a plurality of recording media contained therein on the loading part and the feeding by loading a plurality of recording media on the loading part can be selectively performed. Also, according to the embodiment, the mediapack and naked recording media loaded on the common loading part can be respectively fed by the same feeding means, so that the entire feeding device and the recording apparatus can be miniaturized.

According to the embodiment, by the restricting means for restricting the position of the storage case to the feeding roller when the recording media are abutted against the feeding roller by the pressure plate, the relative position between the loaded storage case and the feeding roller is restricted, so that the entire storage case can be securely prevented from floating from the pressure plate of the loading part. Therefore, according to the embodiment, from a plurality of the recording media within the storage case loaded on the loading part, one sheet can be separated at a time for excellent feeding.

According to the embodiment, the restricting means is provided in the rotating shaft of the feeding roller, so that the restricting operation can be securely performed simultaneously with the feeding operation by the feeding roller.

According to the embodiment, there are provided the protruding member disposed movably between a protruded state, in which the protruding member protrudes close to the feeding roller from the principal surface of the pressure plate and a retracted state, in which the protruding member does not protrude from the principal surface of the pressure plate; and the switching means for switching the protruding member between the protruded state and the retracted state, so that the pressing force by the pressure plate can be securely transmitted to the recording media within the storage case. Therefore, according to the present invention, the recording media fed from the inside of the storage case can be excellently brought into contact with the feeding roller and can be excellently fed by the feeding roller.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A feeding device for feeding recording media comprising:

a loading unit adapted to allow one of a plurality of recording media and a storage case having a plurality of recording media contained therein to be selectively loaded thereon; and feeding means for feeding the recording media from the loading unit, wherein the feeding means comprises:

a feeding roller for feeding the recording media;

a pressure plate for pressing the recording media loaded on the loading unit into contact with the feeding roller; and restricting means for restricting the position of the storage case relative to the feeding roller when the pressure plate is pressing the recording media into contact with the feeding roller.

2. A device according to claim 1, wherein the restricting means is disposed in a rotational shaft of the feeding roller.

3. A device according to claim 1, further comprising:

a protruding member disposed movably between a protruded state where the protruding member protrudes from a surface of the pressure plate for loading recording media towards the feeding roller and a retracted state in that the protruding member does not protrude from a surface of the pressure plate; and switching means for switching the protruding member between the protruded state when the storage case is loaded on the loading unit and the retracted state when the recording media not contained in the storage case are loaded on the loading unit.

4. A device according to claim 3, wherein a protruding amount of the protruding member is controlled corresponding to the number of the recording media within the storage case.

5. A device according to claim 1, further comprising a protruding member disposed movably between a protruded state where the protruding member protrudes from a surface of the pressure plate for loading recording media towards the feeding roller and a retracted state where the protruding member does not protrude from a surface of the pressure plate, wherein when the storage case is loaded on the loading unit, the feeding roller is above the storage case and the protruding member is below the storage case.

6. A recording apparatus for recording information on recording media comprising:

a loading unit adapted to allow one of a plurality of recording media and a storage case having a plurality of recording media contained therein to be selectively loaded thereon;

a recording unit; and feeding means for feeding the recording media from the loading unit to said recording unit, wherein the feeding means comprises:

a feeding roller for feeding the recording media;

a pressure plate for pressing the recording media loaded on the loading unit into contact with the feeding roller; and restricting means for restricting the position of the storage case relative to the feeding roller when the pressure plate is pressing the recording media into contact with the feeding roller.

7. An apparatus according to claim 6, wherein the restricting means is disposed in a rotational shaft of the feeding roller.

8. An apparatus according to claim 6, further comprising:

a protruding member disposed movably between a protruded state where the protruding member protrudes from a surface of the pressure plate for loading recording media towards the feeding roller and a retracted state in that the protruding member does not protrude from a surface of the pressure plate; and switching means for switching the protruding member between the protruded state when the storage case is loaded on the loading unit and the retracted state when the recording media not contained in the storage case are loaded on the loading unit.

9. An apparatus according to claim 8, wherein a protruding amount of the protruding member is controlled corresponding to the number of the recording media within the storage case.

10. An apparatus according to claim 6, further comprising a protruding member disposed movably between a protruded state where the protruding member protrudes from a surface of the pressure plate for loading recording media towards the feeding roller and a retracted state where the protruding member does not protrude from a surface of the pressure plate, wherein when the storage case is loaded on the loading unit, the feeding roller is above the storage case and the protruding member is below the storage case.

11. An apparatus according to claim 6, wherein said recording unit performs recording on recording media by ejecting ink from nozzles.

* * * * *

UNITED STATES PATENT AND TRADEMARK OFFICE

CERTIFICATE OF CORRECTION

PATENT NO. : 6,793,425 B2
DATED : September 21, 2004
INVENTOR(S) : Junichi Yoshikawa et al.

It is certified that error appears in the above-identified patent and that said Letters Patent is hereby corrected as shown below:

Column 2,
Line 8, "to" should be deleted.
Line 11, "simply to" should read -- to simply --.

Column 19,
Line 55, "also can" should read -- can also --.

Signed and Sealed this

Twenty-first Day of December, 2004

JON W. DUDAS
*Director of the United States Patent and Trademark Office*